US008336979B2

(12) United States Patent
Oshima

(10) Patent No.: US 8,336,979 B2
(45) **Date of Patent: *Dec. 25, 2012**

(54) LIQUID JETTING DEVICE

(75) Inventor: Atsushi Oshima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 77 days.

This patent is subject to a terminal disclaimer.

(21) Appl. No.: 12/624,206

(22) Filed: Nov. 23, 2009

(65) Prior Publication Data

US 2010/0097419 A1 Apr. 22, 2010

Related U.S. Application Data

(62) Division of application No. 11/975,542, filed on Jan. 10, 2008, now Pat. No. 7,731,317.

(30) Foreign Application Priority Data

Jan. 12, 2007 (JP) ..... 2007-004092
Dec. 10, 2007 (JP) ..... 2007-318586

(51) Int. Cl.
*B41J 29/38* (2006.01)

(52) U.S. Cl. ..... 347/10; 347/11; 347/12; 347/13

(58) Field of Classification Search ..... None
See application file for complete search history.

(56) References Cited

U.S. PATENT DOCUMENTS 2,915,589 A 12/1959 Plant
3,462,698 A * 8/1969 Yagher, Jr ..... 330/273
4,254,439 A 3/1981 Fowler et al.
4,992,749 A 2/1991 Tokumo et al.
5,262,733 A 11/1993 Nakajima et al.
5,283,658 A 2/1994 Hayashi et al.
5,406,314 A 4/1995 Kuehnle
5,475,405 A 12/1995 Widder et al.
5,675,296 A 10/1997 Tomikawa
5,894,314 A 4/1999 Tajika et al.
6,133,844 A 10/2000 Ahne et al.
6,267,519 B1 7/2001 Otsuki et al.
6,312,076 B1 11/2001 Taki et al.
6,312,096 B1 11/2001 Koitabashi et al.
(Continued)

FOREIGN PATENT DOCUMENTS

EP 1594224 A1 11/2005
(Continued)

OTHER PUBLICATIONS

Machine translation of JP 2006-272907 A.*

(Continued)

*Primary Examiner* — Matthew Luu
*Assistant Examiner* — Justin Seo
(74) *Attorney, Agent, or Firm* — DLA Piper LLP (US)

(57) ABSTRACT

A liquid jetting device includes a plurality of nozzles. A driving signal generated by a driving signal generating section is applied to a charge-discharge actuator in correspondence with each nozzle to jet liquid from the nozzle. A charging source potential preliminary adjusted wave-form signal is pulse modulated and electrically amplified using a charging source potential transistor pair connected in a push-pull configuration, and output by a ripple filter to a collector of a charge-use transistor of the driving signal generating section to make a preliminary adjustment to the charging source potential for the driving signal generating section.

3 Claims, 14 Drawing Sheets

U.S. PATENT DOCUMENTS

| | | | |
|---|---|---|---|
| 6,320,605 | B1 | 11/2001 | Ikeda et al. |
| 6,344,811 | B1 | 2/2002 | Melanson |
| 6,364,443 | B1 | 4/2002 | Katano et al. |
| 6,378,996 | B1 | 4/2002 | Shimada et al. |
| 6,431,676 | B2 | 8/2002 | Asauchi et al. |
| 6,443,547 | B1 | 9/2002 | Takahashi et al. |
| 6,454,377 | B1 | 9/2002 | Ishizaki |
| 6,457,794 | B1 | 10/2002 | Tajika et al. |
| 6,474,762 | B2 | 11/2002 | Taki et al. |
| 6,502,930 | B1 | 1/2003 | Shimada et al. |
| 6,652,055 | B2 | 11/2003 | Oikawa |
| 6,739,686 | B2 | 5/2004 | Imai |
| 6,758,544 | B2 | 7/2004 | Fukano |
| 6,776,469 | B2 | 8/2004 | Nozawa |
| 7,038,534 | B2 | 5/2006 | Hanzlik |
| 7,083,274 | B2 | 8/2006 | Morita et al. |
| 7,111,755 | B2 | 9/2006 | Koyama et al. |
| 7,170,544 | B2 | 1/2007 | Horiuchi |
| 7,244,007 | B2 | 7/2007 | Ishizaki |
| 7,252,355 | B2 | 8/2007 | Umeda |
| 7,357,496 | B2 | 4/2008 | Silverbrook et al. |
| 7,384,128 | B2 | 6/2008 | Sheahan et al. |
| 7,571,989 | B2 | 8/2009 | Ishizaki |
| 7,581,802 | B2 | 9/2009 | Tabata et al. |
| 7,585,037 | B2 | 9/2009 | Tabata et al. |
| 7,717,530 | B2 | 5/2010 | Oshima |
| 7,731,317 | B2 | 6/2010 | Oshima |
| 7,748,812 | B2 | 7/2010 | Oshima |
| 7,758,140 | B2 | 7/2010 | Oshima et al. |
| 7,850,265 | B2 | 12/2010 | Ishizaki |
| 2002/0113832 | A1 | 8/2002 | Kanematsu |
| 2002/0142733 | A1 | 10/2002 | Nishinakagawa |
| 2002/0163458 | A1 | 11/2002 | Jin |
| 2003/0112297 | A1 | 6/2003 | Hiratsuka et al. |
| 2003/0231179 | A1 | 12/2003 | Suzuki |
| 2004/0047477 | A1 | 3/2004 | Bank et al. |
| 2004/0119770 | A1 | 6/2004 | Tamura |
| 2004/0233241 | A1 | 11/2004 | Salacz |
| 2005/0116977 | A1 | 6/2005 | Shinkawa et al. |
| 2005/0231179 | A1 | 10/2005 | Ishizaki |
| 2005/0248399 | A1 | 11/2005 | Kurokawa |
| 2006/0132231 | A1 | 6/2006 | Ishii et al. |
| 2006/0181342 | A1 | 8/2006 | Kanoh |
| 2007/0120938 | A1 | 5/2007 | Fitzpatrick et al. |
| 2008/0018683 | A1 | 1/2008 | Oshima et al. |
| 2008/0018686 | A1 | 1/2008 | Oshima et al. |
| 2008/0100652 | A1 | 5/2008 | Oshima et al. |
| 2008/0186350 | A1 | 8/2008 | Oshima et al. |
| 2008/0198191 | A1 | 8/2008 | Oshima et al. |
| 2009/0033698 | A1 | 2/2009 | Suzuki et al. |
| 2009/0066739 | A1 | 3/2009 | Tabata et al. |
| 2009/0140780 | A1 | 6/2009 | Miyazaki et al. |
| 2009/0213152 | A1 | 8/2009 | Tabata et al. |
| 2009/0267979 | A1 | 10/2009 | Tabata et al. |
| 2009/0289980 | A1 | 11/2009 | Tabata et al. |
| 2009/0303271 | A1 | 12/2009 | Tabata et al. |
| 2010/0091059 | A1 | 4/2010 | Oshima et al. |
| 2010/0118078 | A1 | 5/2010 | Oshima et al. |
| 2010/0188452 | A1 | 7/2010 | Oshima |
| 2010/0220133 | A1 | 9/2010 | Oshima et al. |
| 2011/0002486 | A1 | 1/2011 | Ishizaki |
| 2011/0102486 | A1 | 5/2011 | Tabata et al. |
| 2011/0109674 | A1 | 5/2011 | Oshima et al. |

FOREIGN PATENT DOCUMENTS

| | | | |
|---|---|---|---|
| JP | 63247059 | A | 10/1988 |
| JP | 02262705 | A | 10/1990 |
| JP | 03147446 | A | 6/1991 |
| JP | 05077456 | A | 3/1993 |
| JP | 05199044 | A | 8/1993 |
| JP | 6041208 | B | 6/1994 |
| JP | 09234865 | A | 9/1997 |
| JP | 09300618 | A | 11/1997 |
| JP | 09308264 | A | 11/1997 |
| JP | 10-081013 | | 3/1998 |
| JP | 10210757 | A | 8/1998 |
| JP | 11058733 | A | 3/1999 |
| JP | 11204850 | A | 7/1999 |
| JP | 2000117980 | A | 4/2000 |
| JP | 2000238262 | A | 9/2000 |
| JP | 2000245162 | A | 9/2000 |
| JP | 2001121697 | A | 5/2001 |
| JP | 2001162794 | A | 6/2001 |
| JP | 2001268922 | A | 9/2001 |
| JP | 2002204595 | A | 7/2002 |
| JP | 2002536903 | A | 10/2002 |
| JP | 2003001824 | A | 1/2003 |
| JP | 2003237068 | A | 8/2003 |
| JP | 2004048886 | A | 2/2004 |
| JP | 2004-306434 | | 11/2004 |
| JP | 2004306434 | A | 11/2004 |
| JP | 2005035062 | A | 2/2005 |
| JP | 2005065068 | A | 3/2005 |
| JP | 2005075475 | A | 3/2005 |
| JP | 2005131928 | A | 5/2005 |
| JP | 2005322957 | A | 11/2005 |
| JP | 2005329710 | A | 12/2005 |
| JP | 2005349576 | A | 12/2005 |
| JP | 2006025151 | A | 1/2006 |
| JP | 2006231882 | A | 9/2006 |
| JP | 2006256151 | A | 9/2006 |
| JP | 2006-272907 | | 10/2006 |
| JP | 2006272907 | A * | 10/2006 |
| JP | 2006304490 | A | 11/2006 |
| JP | 2007069555 | A | 3/2007 |
| JP | 2007096364 | A | 4/2007 |
| JP | 2007144867 | A | 6/2007 |
| JP | 2007168172 | A | 7/2007 |
| JP | 2008049698 | A | 3/2008 |
| JP | 2008049699 | A | 3/2008 |
| JP | 2008087467 | A | 4/2008 |
| WO | 0046919 | A2 | 8/2000 |

OTHER PUBLICATIONS

Machine translation of JP 2006-272907 A (publication date of JP 2006-272907 A: Oct. 12, 2006).*

U.S. office action dated Oct. 27, 2011 for related U.S. Appl. No. 12/158,591 cites the U.S. patent above.

U.S. notice of allowance dated Nov. 25, 2011 for related U.S. Appl. No. 12/637,412 cites the U.S. patent application publications above.

U.S. final office action dated Jan. 9, 2012 issued in related U.S. Appl. No. 12/389,525 cites the U.S. patent application publication above.

U.S. notice of allowance dated Jan. 13, 2012 issued in related U.S. Appl. No. 12/161,201 cites the U.S. patent application publication above.

U.S. final office action dated Apr. 14, 2011 issued in related U.S. Appl. No. 12/161,201 cites the U.S. patent above.

U.S. notice of allowance dated Jun. 6, 2011 issued in related U.S. Appl. No. 12/637,412 cites the publications above.

U.S. office action dated Aug. 23, 2010 issued in related U.S. Appl. No. 12/637,412 cites the publications above.

U.S. office action dated Dec. 27, 2010 issued in related U.S. Appl. No. 12/026,129 cites the publications above.

U.S. office action dated Jun. 14, 2011 issued in related U.S. Appl. No. 12/026,129 cites the publications above.

U.S. office action dated Dec. 27, 2010 issued in related U.S. Appl. No. 12/027,175 cites the publications above.

U.S. office action dated Jun. 15, 2011 issued in related U.S. Appl. No. 12/027,175 cites the publications above.

U.S. office action dated Jun. 21, 2011 issued in related U.S. Appl. No. 12/161,900 cites the publications above.

U.S. office action dated Sep. 28, 2010 issued in related U.S. Appl. No. 12/161,201 cites the publications above.

U.S. office action dated Mar. 30, 2010 issued in related U.S. Appl. No. 12/161,148 cites the publications above.

U.S. office action dated Sep. 16, 2010 issued in related U.S. Appl. No. 12/161,148 cites the publications above.

U.S. office action dated Mar. 4, 2011 issued in related U.S. Appl. No. 11/780,357 cites the publications above.

U.S. office action dated May 12, 2010 issued in related U.S. Appl. No. 11/780,357 cites the publications above.

U.S. office action dated Oct. 28, 2009 issued in related U.S. Appl. No. 11/780,357 cites the publications above.
U.S. office action dated Mar. 4, 2011 issued in related U.S. Appl. No. 11/780,379 cites the publications above.
U.S. office action dated Aug. 20, 2010 issued in related U.S. Appl. No. 11/780,379 cites the publications above.
U.S. office action dated Mar. 3, 2010 issued in related U.S. Appl. No. 11/780,379 cites the publications above.
U.S. office action dated Nov. 30, 2010 issued in related U.S. Appl. No. 12/689,926 cites the publications above.
U.S. office action dated Jun. 27, 2008 issued in related U.S. Appl. No. 11/780,301 cites the publications above.
U.S. office action dated Feb. 20, 2009 issued in related U.S. Appl. No. 11/780,301 cites the publications above.
U.S. notice of allowance dated Jun. 16, 2009 issued in related U.S. Appl. No. 11/780,301 cites the publications above.
U.S. notice of allowance dated Apr. 8, 2009 issued in related U.S. Appl. No. 11/780,390 cites the publications above.
U.S. notice of allowance dated Dec. 17, 2010 issued in related U.S. Appl. No. 12/498,296 cites the publications above.
U.S. office action dated May 28, 2009 issued in related U.S. Appl. No. 11/849,582 cites the publications above.
U.S. office action dated Dec. 30, 2009 issued in related U.S. Appl. No. 11/849,582 cites the publications above.
U.S. notice of allowance dated Apr. 19, 2010 issued in related U.S. Appl. No. 11/849,582 cites the publications above.
U.S. office action dated Nov. 27, 2009 issued in related U.S. Appl. No. 11/923,448 cites the publications above.
U.S. office action dated Apr. 28, 2010 issued in related U.S. Appl. No. 11/923,448 cites the publications above.
U.S. notice of allowance dated Apr. 5, 2010 issued in related U.S. Appl. No. 11/972,542 cites the publications above.
U.S. notice of allowance dated Apr. 12, 2010 issued in related U.S. Appl. No. 12/340,940 cites the publications above.
U.S. notice of allowance dated Jan. 4, 2010 issued in related U.S. Appl. No. 12/351,472 cites the publications above.
U.S. office action dated Oct. 8, 2010 issued in related U.S. Appl. No. 12/752,367 cites the publications above.
U.S. office action dated May 4, 2011 issued in related U.S. Appl. No. 12/389,525 cites the publications above.
U.S. office action dated Sep. 30, 2010 issued in related U.S. Appl. No. 12/509,915 cites the publications above.
Extended European search report dated Jan. 28, 2010 issued in corresponding European application 07706915.1.

* cited by examiner

LIQUID JETTING DEVICE

This application is a divisional of application Ser. No. 11/972,542, filed on Jan. 10, 2008, and claims the benefit of priority under 35USC 119 of Japanese Patent Application Nos. 2007-004092 and 2007-318586, filed Jan. 12, 2007 and Dec. 10, 2007, respectively, which are expressly incorporated by reference herein.

BACKGROUND

1. Field of the Invention

The present invention relates to a liquid jetting device that jets, for instance, a plurality of fine colored-liquid droplets from a plurality of nozzles to form dots on a print medium for drawing predetermined characters and images.

2. Description of the Related Art

One example of such a liquid jetting device, the inkjet printer, has with the popularization of personal computers digital cameras and the like become popular not only in offices but among private users as a result of its ability to produce high quality color prints of a high quality at low cost.

Such inkjet printers are generally constructed to produce the desired printed matter by drawing predetermined characters and images on the print medium through jet of liquid ink droplets from print head nozzles and formation of fine ink dots on the print medium as a movable body, which is integrally equipped with ink cartridges and print heads and known as a carriage, moves back and forth over the print medium in the direction which intersects with the conveyed direction of the print medium. By including of ink cartridges of four colors including black (and yellow, magenta, and cyan) and a print head corresponding to each color, the inkjet printers are configured to allow both monochrome and, through combination of the colors, full color printing (inkjet printers further including arrangements for additional colors, such as light cyan and light magenta, to give six, seven or eight colors are also in use).

The inkjet printers of the type which execute printing by passing the inkjet head on the carriage back and forth in the intersecting direction with the conveyed direction of the print medium must make from around ten passes to several tens of passes to make a good print of an entire. Contrastingly, in inkjet printers of the type which avoid use of a carriage by providing long inkjet heads (which need not be integrated with the cartridges) of substantially the same width as the print medium, there is no need to move inkjet head in the width direction of the print medium and the printing can be completed in a single pass. The inkjet printers using the former method are generally called "multipass (serial) inkjet printers", and inkjet printers using the latter type are generally called "line-head inkjet printers".

At present, further improvements in "gradation" are being demanded in these types of inkjet printer. Gradation refers to states of concentration of each color in a so-called pixel expressed as an ink dot. A size of the ink dot, which dependent on the concentrations of the colors in the pixel, is called a degree of gradation, and a number for the degree of gradation possible using ink dots is called a gradation number. High gradation is used to mean a large gradation number. To change the degree of gradation, it is for instance necessary to change a driving pulse to an actuator provided in the inkjet head. If the actuator is a piezoelectric device, an amount of displacement (deformation) of the piezoelectric device (more accurately, a diaphragm) will increase as the applied voltage to the piezoelectric device is increased, and it is therefore possible to change the degree of gradation.

In JP-A-10-81013, for instance, a driving signal is generated by combining and linking a plurality of driving pulses having differing peak values. The generated driving signal is outputted to all piezoelectric devices corresponding to nozzles of a given same color provided on the inkjet head. The desired degree of gradation in the ink dot is then achieved by selecting, for each nozzle, a driving pulse corresponding to the degree of gradation in the ink dot to be formed and supplying the selected driving pulses to the corresponding piezoelectric devices to jet ink droplets.

A method for generating the driving signals (or driving pulses) is recorded, for instance, in FIG. 2 of JP-A-2004-306434 which is described below. In this method, the inkjet printer reads data from a memory storing the driving signal data, converts the read data to analog data using a D/A converter, and supplies the resulting driving signal to the inkjet heads via a current amplifier. Since the piezoelectric device is a charge-discharge actuator, the driving signal causes the charge-discharge actuator to charge and discharge. The current amplifier circuit is, as shown in FIG. 3 of the same application, constructed using a charge-use transistor and a discharge-use transistor connected in a push-pull configuration. Further, the current amplifier configuration makes use of a high power source potential, and amplifies the driving signal using so-called linear drive. However, in current amplifiers with this type of configuration, a potential difference between the power source potential and the driving signal for charging the charge-discharge actuator and a potential difference between the ground potential and the driving signal for discharging the actuator are both large, and such amplifiers therefore consume a great deal of power. The majority of the consumed power is dissipated as heat, and large transistors and heat sinks are therefore required. The large size of the heat sinks, in particular, is a serious hindrance with regards to layout.

To overcome this disadvantage, in the inkjet printer disclosed in JP-A-2006-272907 a source potential adjusting transistor is provided between a power source and the charge-use transistor, and a charging source potential adjusted using the source potential adjusting transistor is supplied to a collector of the charge-use transistor via a ripple filter. Further an earth connection (discharging connection) potential adjusting transistor is provided between an earth connection (discharging connection) and the discharge-use transistor, and an earth connection (discharging connection) potential adjusted by the earth connection (discharging connection) potential adjusting transistor is supplied to a collector of the discharge-use transistor via a ripple filter. Such an arrangement reduces the potential difference between the charging source potential and the driving signal for charging the actuator and the potential difference between the earth connection (discharging connection) potential and the driving signal from the discharging actuator, thereby reducing power consumption.

However, in the inkjet printer disclosed in JP-A-2006-272907, since only a single charging source potential adjusting transistor is provided between the power source and the charge-use transistor and only a single earth connection (discharging connection) potential adjusting transistor is provided between the earth connection (discharging connection) and the discharge-use transistor, it is not possible to sufficiently close the gap between a charging source potential preliminary adjusted signal supplied to the charge-use transistor and the charging potential of the charge-discharge actuator, or to close the gap between an earth connection (discharging connection) potential preliminary adjusted signal and the discharge potential. Since, the potential differences represented by the gaps cannot be reduced, the disclosed arrangement is incapable of sufficiently reducing power consumption.

The present invention provides a liquid jetting device capable of reducing both the potential difference between the charging source potential preliminary adjusted signal and the driving signal for charging the charge-discharge actuator and the potential difference between the discharging connection potential preliminary adjusted signal and the driving signal from the charge-discharge actuator when discharging, and thereby allows a reduction in power consumption.

SUMMARY

To solve the above described problems, the present invention provides a liquid jetting device including a plurality of nozzles provided in a liquid jetting head, a charge-discharge actuator provided in correspondence with each nozzle, and a driving section for applying a driving signal to the charge-discharge actuator to jet liquid from the corresponding nozzle, the liquid jetting device including: a driving wave-form signal generating section configured to generate a driving wave-form signal as a basis of a signal for controlling a drive state of the actuator; a driving signal generating section configured to amplify the driving wave-form signal generated by the driving wave-form signal generating section using a charge-use transistor and a discharge-use transistor connected in a push-pull configuration, and output a driving signal; a charging source potential preliminary adjusted wave-form signal generating section configured to generate a charging source potential preliminary adjusted wave-form signal for making a preliminary adjustment to a potential of a charging source for the driving signal generating section; and a charging source potential preliminary adjustment section provided between the charging source of the driving signal generating section and the driving signal generating section, and configured to make a preliminary adjustment to the charging source potential for the driving signal generating section based on the charging source potential preliminary adjusted wave-form signal generated by the charging source potential preliminary adjusted wave-form signal generating section, wherein the charging source potential preliminary adjustment section includes: a charging source potential modulating subsection configured to perform pulse modulation on the charging source potential preliminary adjusted wave-form signal generated by the charging source potential preliminary adjusted wave-form signal generating section; a charging source potential digital power amplifier configured to electrically amplify, using a charging source potential transistor pair connected in a push-pull configuration, a charging source potential modulated signal resulting from pulse modulation by the charging source potential modulating subsection; and a charging source potential ripple filter configured to output the charging source potential preliminary adjusted signal resulting from power amplification by the charging source potential digital power amplifier to a collector of the charge-use transistor of the driving signal generating section.

According to the liquid jetting device of this invention, it is possible to reduce the potential difference between the charging source potential preliminary adjusted signal and the driving signal for charging the charge-discharge actuator, and thereby reduce power consumption.

In the liquid jetting device of the present invention, the charging source potential preliminary adjusted wave-form signal generating section may generate the charging source potential preliminary adjusted wave-form signal for adjusting the potential of the charging source potential preliminary adjusted signal by adjusting a voltage value of the charging source potential preliminary adjusted signal.

According to the liquid jetting device of this invention, it is possible to improve an accuracy of the driving signal and further reduce power consumption.

Further, in the liquid jetting device of the present invention, the charging source potential preliminary adjusted wave-form signal generating section may generate the charging source potential preliminary adjusted wave-form signal for adjusting the potential of the charging source potential preliminary adjusted signal by adjusting a phase of the charging source potential preliminary adjusted signal.

According to the liquid jetting device of this invention, it is possible to improve an accuracy of the driving signal and further reduce power consumption.

Further the present invention provides a liquid jetting device including a plurality of nozzles provided in a liquid jetting head, a charge-discharge actuator provided in correspondence with each nozzle, and a driving section for applying a driving signal to the charge-discharge actuator to jet liquid from the corresponding nozzle, the liquid jetting device including: a driving wave-form signal generating section configured to generate a driving wave-form signal as a basis of a signal for controlling a drive state of the actuator; a driving signal generating section configured to amplify the driving wave-form signal generated by the driving wave-form signal generating section using a charge-use transistor and a discharge-use transistor connected in a push-pull configuration, and output a driving signal; a discharging connection preliminary adjusted wave-form signal generating section configured to generate a discharging connection potential preliminary adjusted wave-form signal for making a preliminary adjustment to a potential of a discharging connection of the driving signal generating section; and a discharging connection potential preliminary adjustment section provided between the discharging connection of the driving signal generating section and the driving signal generating section, and configured to make a preliminary adjustment to the discharging connection potential of the driving signal generating section based on the discharging connection potential preliminary adjusted wave-form signal generated by the discharging connection potential preliminary adjusted wave-form signal generating section, wherein the discharging connection potential preliminary adjustment section includes: a discharging connection potential modulating subsection configured to perform pulse modulation on the discharging connection potential preliminary adjusted wave-form signal generated by the discharging connection potential preliminary adjusted wave-form signal generating section; a discharging connection potential digital power amplifier configured to electrically amplify, using a discharging connection potential transistor pair connected in a push-pull configuration, a discharging connection potential modulated signal resulting from pulse modulation by the discharging connection potential modulating subsection; and a discharging connection potential ripple filter configured to output the discharging connection potential preliminary adjusted signal resulting from power amplification by the discharging connection potential digital power amplifier to a collector of the discharge-use transistor of the driving signal generating section.

According to the liquid jetting device of this invention, it is possible to reduce the potential difference between the discharging connection potential preliminary adjusted signal and the driving signal for discharging the charge-discharge actuator, and thereby reduce power consumption.

Further, in the liquid jetting device of the present invention, the discharging connection potential preliminary adjusted wave-form signal generating section may generate the discharging connection potential preliminary adjusted wave-form signal for adjusting the potential of the discharging connection potential preliminary adjusted signal by adjusting a voltage value of the discharging connection potential preliminary adjusted signal.

According to the liquid jetting device of this invention, it is possible to improve an accuracy of the driving signal and further reduce power consumption.

Further, in the liquid jetting device of the present invention, the discharging connection potential preliminary adjusted wave-form signal generating section may generate the discharging connection potential preliminary adjusted wave-form signal for adjusting the potential of the discharging source potential preliminary adjusted signal by adjusting a phase of the discharging connection potential preliminary adjusted signal.

According to the liquid jetting device of this invention, it is possible to improve an accuracy of the driving signal and further reduce power consumption.

Further, the liquid jetting device of the present invention further include a liquid jetting device including a plurality of nozzles provided in a liquid jetting head, a charge-discharge actuator provided in correspondence with each nozzle, and a driving section for applying a driving signal to the charge-discharge actuator to jet liquid from the corresponding nozzle, the liquid jetting device including: a driving wave-form signal generating section configured to generate a driving wave-form signal as a basis of a signal for controlling a drive state of the actuator; a driving signal generating section configured to amplify the driving wave-form signal generated by the driving wave-form signal generating section using a charge-use transistor and a discharge-use transistor connected in a push-pull configuration, and output a driving signal; a charging source potential preliminary adjusted wave-form signal generating section configured to generate a charging source potential preliminary adjusted wave-form signal for making a preliminary adjustment to a potential of a charging source for the driving signal generating section; and a charging source potential preliminary adjustment section provided between the charging source for the driving signal generating section and the driving signal generating section and configured to make a preliminary adjustment to the charging source potential for the driving signal generating section based on the charging source potential preliminary adjusted wave-form signal generated by the charging source potential preliminary adjusted wave-form signal generating section, a discharging connection potential preliminary adjusted wave-form signal generating section configured to generate a discharging connection potential preliminary adjusted wave-form signal for making a preliminary adjustment to a potential of a discharging connection of the driving signal generating section; a discharging connection potential preliminary adjustment section provided between the discharging connection of the driving signal generating section and the driving signal generating section, and configured to make a preliminary adjustment to the discharging connection potential of the driving signal generating section based on the discharging connection potential preliminary adjusted wave-form signal generated by the discharging connection potential preliminary adjusted wave-form signal generating section, wherein the charging source potential preliminary adjustment section includes: a charging source potential modulating subsection configured to perform pulse modulation on the charging source potential preliminary adjusted wave-form signal generated by the charging source potential preliminary adjusted wave-form signal generating section; a charging source potential digital power amplifier configured to electrically amplify, using a charging source potential transistor pair connected in a push-pull configuration, a charging source potential modulated signal resulting from pulse modulation by the charging source potential modulating subsection; and a charging source potential ripple filter configured to output the charging source potential preliminary adjusted signal resulting from power amplification by the charging source potential digital power amplifier to a collector of the charge-use transistor of the driving signal generating section, wherein the discharging connection potential preliminary adjustment section includes: a discharging connection potential modulating subsection configured to perform pulse modulation on the discharging connection potential preliminary adjusted wave-form signal generated by the discharging connection potential preliminary adjusted wave-form signal generating section; a discharging connection potential digital power amplifier configured to electrically amplify, using a discharging connection potential transistor pair connected in a push-pull configuration, a discharging connection potential modulated signal resulting from pulse modulation by the discharging connection potential modulating subsection; and a discharging connection potential ripple filter configured to output the discharging connection potential preliminary adjusted signal resulting from power amplification by the discharging connection potential digital power amplifier to a collector of the discharge-use transistor of the driving signal generating section.

According to the liquid jetting device of this invention, it is possible to reduce both the potential difference between the charging source potential preliminary adjusted signal and the driving signal for charging the charge-discharge actuator and the potential difference between the discharging connection potential preliminary adjusted signal and the driving signal for discharging the charge-discharge actuator, and thereby reduce power consumption.

Further, in the liquid jetting device of the present invention, the charging source potential preliminary adjusted wave-form signal generating section may generate the charging source potential preliminary adjusted wave-form signal for adjusting the potential of the charging source potential preliminary adjusted signal by adjusting a voltage value of the charging source potential preliminary adjusted signal, and the discharging connection potential preliminary adjusted wave-form signal generating section may generate the discharging connection potential preliminary adjusted wave-form signal for adjusting the potential of the discharging connection potential preliminary adjusted signal by adjusting a voltage value of the discharging connection potential preliminary adjusted signal.

According to the liquid jetting device of this invention, it is possible to improve an accuracy of the driving signal and further reduce power consumption.

Further, in the liquid jetting device of the present invention, the charging source potential preliminary adjusted wave-form signal generating section may generate the charging source potential preliminary adjusted wave-form signal for adjusting the potential of the charging source potential preliminary adjusted signal by adjusting a phase of the charging source potential preliminary adjusted signal, and the discharging connection potential preliminary adjusted wave-form signal generating section may generate the discharging connection potential preliminary adjusted wave-form signal for adjusting the potential of the discharging connection potential preliminary adjusted signal by adjusting a phase of the discharging connection potential preliminary adjusted signal.

According to the liquid jetting device of this invention, it is possible to improve an accuracy of the driving signal and further reduce power consumption.

Further, the present invention provides a liquid jetting device including a plurality of nozzles provided in a liquid jetting head, a charge-discharge actuator provided in correspondence with each nozzle, and a driving section for applying a driving signal to the charge-discharge actuator to jet liquid from the corresponding nozzle, the liquid jetting device including: a driving wave-form signal generating section configured to generate a driving wave-form signal as a basis of a signal for controlling a drive state of the actuator; a driving signal generating section configured to amplify the driving wave-form signal generated by the driving wave-form signal generating section using a charge-use transistor and a discharge-use transistor connected in a push-pull configuration, and output a driving signal; a charging source and discharging connection potential preliminary adjusted wave-form signal generating section configured to generate a charging source and discharging connection potential preliminary adjusted wave-form signal for making a preliminary adjustment to a potential of a charging source for the driving signal generating section and a potential of a discharging connection of the driving signal generating section; and a charging source and discharging connection potential preliminary adjustment section provided both between the charging source for the driving signal generating section and the driving signal generating section and between the discharging connection of the driving signal generating section and the driving signal generating section, and configured to make a preliminary adjustment to the charging source potential to the driving signal generating section and to the discharging connection potential from the driving signal generating section based on the charging source and discharging connection potential preliminary adjusted wave-form signal generated by the charging source and discharging connection potential preliminary adjusted wave-form signal generating section, wherein the charging source and discharging connection potential preliminary adjustment section includes: a charging source and discharging connection potential modulating subsection configured to perform pulse modulation on the charging source and discharging connection potential preliminary adjusted wave-form signal generated by the charging source and discharging connection potential preliminary adjusted wave-form signal generating section; a charging source and discharging connection potential digital power amplifier configured to electrically amplify, using a charging source and discharging connection potential transistor pair connected in a push-pull configuration, a charging source and discharging connection potential modulated signal resulting from pulse modulation by the charging source and discharging connection potential modulating subsection; and a charging source and discharging connection potential ripple filter configured to output the charging source and discharging connection potential preliminary adjusted signal resulting from power amplification by the charging source and discharging connection potential digital power amplifier to a collector of the charge-use transistor and a collector of the discharge-use transistor of the driving signal generating section.

According to the liquid jetting device of the present invention it is possible to reduce the potential difference between the charging source and discharging connection potential preliminary adjusted signal and the driving signal for charging the charge-discharge actuator, and thereby reduce power consumption.

Further, in the liquid jetting device of the present invention, the charging source and discharging connection potential preliminary adjusted wave-form signal generating section may generate the charging source and discharging connection potential preliminary adjusted wave-form signal for adjusting the potential of, the charging source and discharge connection potential preliminary adjusted signal by adjusting a voltage value of the charging source and discharging connection potential preliminary adjusted signal.

According to the liquid jetting device of this invention, it is possible to improve an accuracy of the driving signal and further reduce power consumption.

Further, in the liquid jetting device of the present invention, the charging source and discharging connection potential preliminary adjusted wave-form signal generating section may generate the charging source and discharge connection potential preliminary adjusted wave-form signal for adjusting the potential of the charging source and discharge connection potential preliminary adjusted signal by adjusting a phase of the charging source and discharging connection potential preliminary adjusted signal.

According to the liquid jetting device of this invention, it is possible to improve an accuracy of the driving signal and further reduce power consumption.

Figure 15:
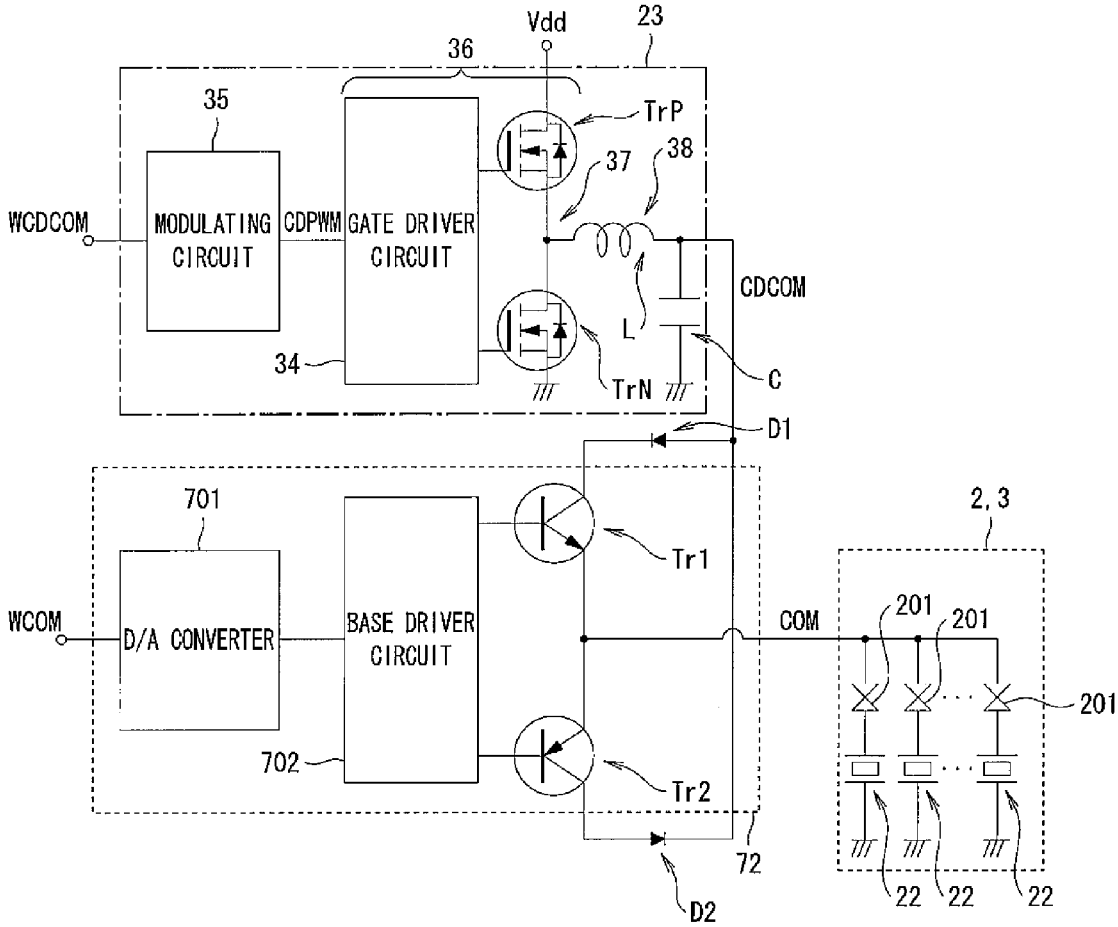
Figure 16A:
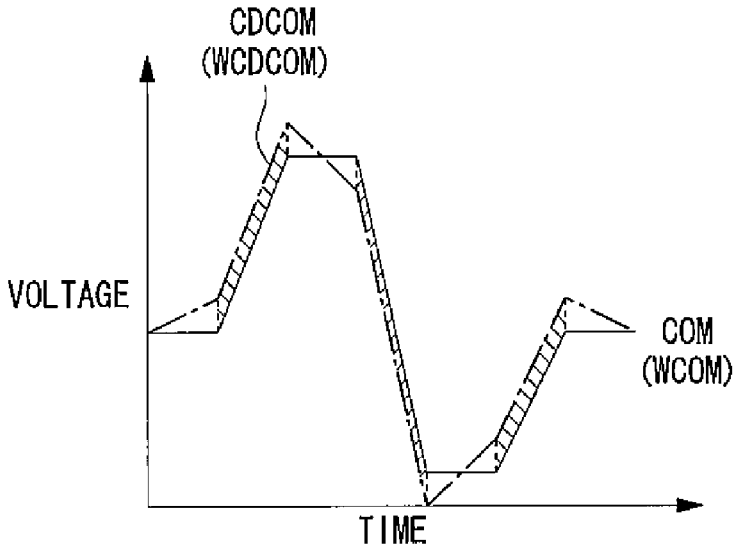
Figure 16B:
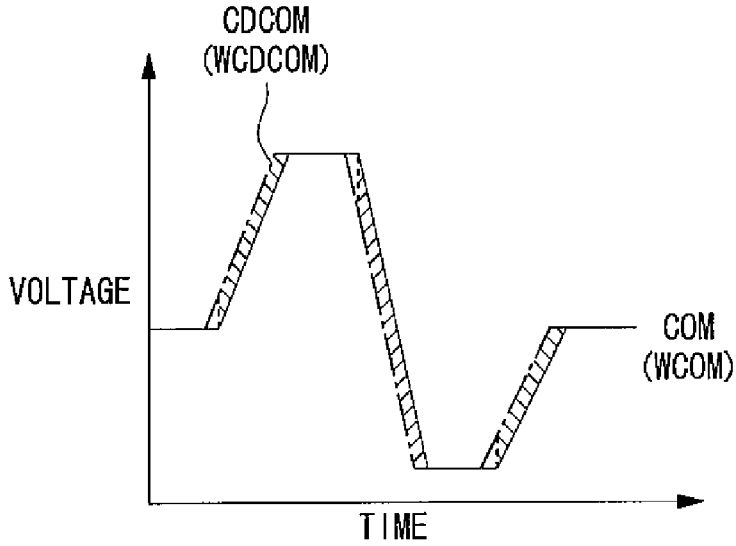

13;

FIG. 15 is a block diagram of a driving signal generating system of a fourth embodiment of the inkjet printer to which the liquid jetting device of the present invention has been applied; and FIGS. 16A and 16B are diagrams illustrating operations of the driving signal generating system of FIG. 15.

DETAILED DESCRIPTION OF THE PREFERRED EMBODIMENTS

The following describes, with reference to the drawings, a first embodiment of an inkjet printer which makes use of the liquid jetting device of the present invention.

Figure 1A:
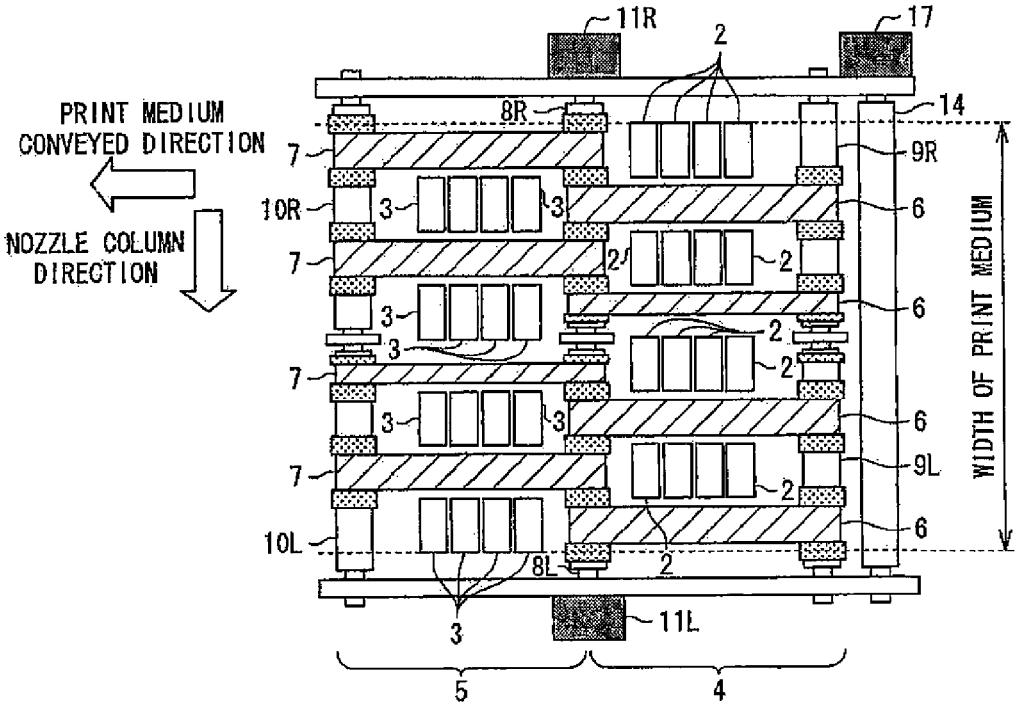
FIGS. 1A and 1B are schematics showing a first embodiment of an inkjet printer to which the liquid jetting device of the present invention is applied, FIG. 1A being a plan view and FIG. 1B being a front elevation.
Figure 1B:
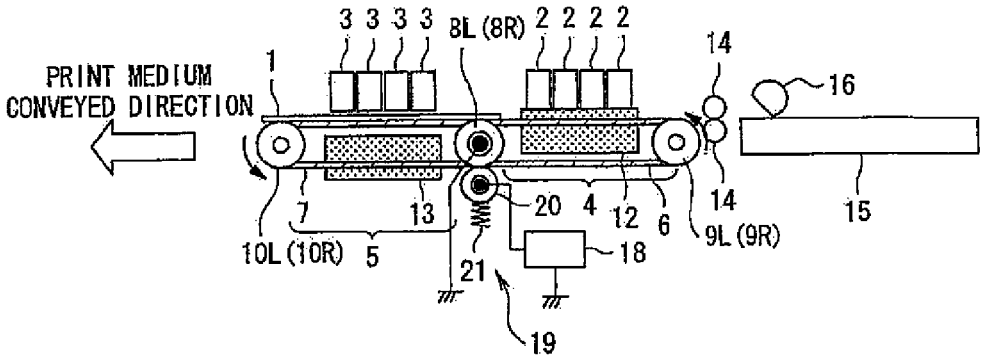

FIGS. 1A and 1B are conceptual views of the inkjet printer of the present embodiment. FIG. 1A is a plan view and FIG. 1B is front view. FIGS. 1A and 1B show a line-head type inkjet printer in which a print medium 1 is conveyed from right to left as shown by the arrow in the drawing and printed upon when conveyed through a printing region. Rather than being provided in a single position, the inkjet heads of the present embodiment are divided between two positions.

In FIGS. 1A and 1B, a symbol 2 denotes a first inkjet head provided on an upstream side of the conveyed direction of the print medium 1, a symbol 3 similarly denotes a second inkjet head provided on a downstream side of the conveyed direction. A first conveyor part 4 for conveying the print medium 1 is provided below the first inkjet head 2 and a second conveyor part 5 is provided below the second inkjet head 3. The first conveyor part 4 is constructed from four first conveyor belts 6 disposed, with a predetermined interval, in a direction (hereinafter also called nozzle column direction) which intersects with the conveyed direction of the print medium 1. The second conveyor part 5 is similarly constructed from four second conveyor belts 7 disposed, with a predetermined interval, in the intersecting direction (nozzle column direction) with the conveyed direction of the print medium 1.

The four first conveyor belts 6 are arranged to adjacently alternate with the four second conveyor belts 7. In the present embodiment, four conveyors made up of two of each of the first conveyor belts 6 and the second conveyor belts 7 and disposed on the right-hand side when viewing in the conveyed direction are separate from the four conveyors, made up of two of each of the first conveyor belts 6 and the second conveyor belts 7 and disposed on the left-hand side. Specifically, a right-hand driving roller 8R is provided at an overlapping section of the four right-hand conveyors, which are made up of two of each of the first conveyor belts 6 and the second conveyor belts 7, and a left-hand driving roller 8R is provided at an overlapping section of the four left-hand conveyors, which are made up of two of each of the first conveyor belts 6 and the second conveyor belts 7. A right-hand first follower roller 9R and a left-hand first follower roller 9L are provided on an upstream side of the driving rollers 8R and 8L and a right-hand second follower roller 10R and a left-hand second follower roller 10L are provided on an downstream side of the driving rollers 8R and 8L. These rollers may look as if they are connected, but are in fact divided at a central section of FIG. 1A. The two right-hand first conveyor belts 6 pass around the right-side driving roller 8R and the right-hand first follower roller 9R, and the two left-hand first conveyor belts 6 pass around the left-hand driving roller 8L and a left-hand first follower roller 9L. The two right-hand second conveyor belts 7 pass around the right-side driving roller 8R and a right-hand second follower roller 10R and the two left-hand second conveyor belts 7 pass around the left-hand driving roller 8L and a left-hand second follower roller 10L. The right-side driving roller 8R is connected to a right-hand electric motor 11R and the left-hand driving roller 8L is connected to a left-hand electric motor 11L. Hence, when the right-side driving roller 8R is rotatably driven by the right-hand electric motor 11R, the first conveyor part 4 made up of the two right-hand first conveyor belts 6 and the second conveyor part 5 made up of the two right-hand second conveyor belts 7 move simultaneously and at a same speed. Also, when the left-side driving roller 8L is rotatably driven by the left-hand electric motor 11L, the first conveyor part 4 made up of the two left-hand first conveyor belts 6 and the second conveyor part 5 made up of the two left-hand second conveyor belts 7 move simultaneously and at a same speed. Note that if the rotation speeds of the right-hand electric motor 11R and the left-hand electric motor 11L are set differently it is possible to change conveyor speeds on the left and right sides. Specifically, if the rotation speed of the right-hand electric motor 11R is increased above the rotation speed of the left-hand electric motor 11L the conveyor speed on the left-hand side can be increased above the conveyor speed on the right-hand side. Similarly if the rotation speed of the left-hand electric motor 11L is increased above the rotation speed of the right-hand electric motor 11R the conveyor speed on the left-hand side can be increased above the conveyor speed on the right-hand side.

The first inkjet heads 2 and the second inkjet heads 3 are arranged in rows so that each color, of four colors which may be yellow (Y), magenta (M), cyan (C), and black (K), is displaced a different amount along the conveyed direction of the print medium 1. The inkjet heads 2 and 3 are supplied with colored ink from ink tanks via an ink tube, none of which are is shown in the drawing. The inkjet heads 2 and 3 include a plurality of nozzles disposed in the direction which intersects with the conveyed direction of the print medium 1 (i.e. the nozzle column direction). An output of fine ink dots on the print medium 1 is formed by having the nozzles simultaneously jet a necessary quantity of ink droplets in required locations. By performing this operation for each color, so-called one pass printing can be achieved with a single pass of the print medium 1 conveyed on the first conveyor part 4 and the second conveyor part 5. Note that the region over which the inkjet heads 2 and 3 are disposed corresponds to the printing region.

Examples of methods for jet output of ink from the nozzles of the inkjet heads include a static method, a piezoelectric method, and a film-boiling method. In the static method, when a driving signal is applied to an electrostatic gap, which is the actuator, a diaphragm within a cavity deforms, causing a change in pressure within the cavity. This change of pressure causes an ink droplet to be jetted from the nozzle. In the piezoelectric method, when a driving signal is applied to a piezoelectric device, which is the actuator, a diaphragm within a cavity deforms, causing a change in pressure within the cavity. This change of pressure causes an ink droplet to be jetted from the nozzle. In the film-boiling method, a very small heater is provided in the cavity. The ink is then instantaneously heated to 300° C. or more and boils to form vapor, and the resulting change in pressure causes the ink droplet to be jetted from the nozzle. The present invention may be applied to any of the ink output methods, but is particularly suitable for the method using a piezoelectric device which allows adjustment to an amount of jetted ink in the droplets through adjustment of the peak values and voltage gradients of the driving signal. Note that the piezoelectric device has a capacitance and is a so-called charge-discharge actuator.

The ink jet nozzles of the first inkjet heads 2 are only formed between the four first conveyor belts 6 of the first conveyor part 4, and the ink jet nozzles of the second inkjet heads 3 are only formed between the four second conveyor belts 7 of the second conveyor part 5. This arrangement is used to allow cleaning of the inkjet heads 2 and 3 by a later-described cleaning part, but does not allow full page printing in just one pass if just one set of the inkjet heads is working. Accordingly, to supply the unprintable sections, the first inkjet heads 2 are arranged so as not to align with the second inkjet heads 3 in the conveyed direction of the print medium 1.

First cleaning caps 12 for cleaning the first inkjet heads 2 are provided below the first inkjet heads 2, and second cleaning caps 13 for cleaning the second inkjet heads 3 are provided below the second inkjet heads 3. The cleaning caps 12 and 13 are sized so as to be able to pass between the first four conveyor belts 6 of the first conveyor part 4 and between the second four conveyor belts 7 of second conveyor part 5 respectively. The first cleaning caps 12 and 13 cover, for instance, a bottom surface of the inkjet heads 2 and 3 (i.e. the nozzles formed on a nozzle surface) and are each constructed from a cap body which is a hollow rectangular cylinder with a base capable of adhering the nozzle surface, an ink absorbing body provided on the base of the cap, a tube pump connected to the base of the cap body, and an elevating device for elevating the cap body. The elevating devices are used to raise the cap bodies to adhere the nozzle surfaces of the inkjet heads 2 and 3. When the pressure inside the cap bodies is pressurized negatively by the pumps with the arrangements in the raised state, ink droplets and bubbles from the nozzle openings formed in the nozzle surfaces of the inkjet heads 2 and 3 are sucked up, thereby cleaning the inkjet heads 2 and 3. When cleaning has been completed, the cleaning caps 12 and 13 are lowered.

Upstream of the first follower rollers 9R and 9L, a pair of gate rollers 14 is provided to adjust a supply timing of the print medium 1 supplied from a paper supplying unit 15 and correct skew in the print medium 1. Skew refers to the twist in the print medium 1 with respect to the conveyed direction. Further, a pick-up roller 16 is provided above the paper supplying unit 15 for supplying the print medium 1. Note that the symbol 17 in FIG. 1A denotes a gate roller motor for driving the gate rollers 14.

A belt electrifying device 19 is provided below the driving rollers 8R and 8L. The belt electrifying device 19 is constructed from an electrostatic roller 20 which sandwiches the first conveyor belts 6 and the second conveyor belts 7 against the driving rollers 8R and 8L, a spring 21 which powers the electrostatic roller 20 towards the first conveyor belts 6 and the second conveyor belts 7, and a power source 18 which applies a charge to the electrostatic roller 20. The electrostatic roller 20 then applies a charge to the first conveyor belts 6 and the second conveyor belts 7 causing electrically charging them. Since the belts are generally constructed using a mid/high-resistance body or an insulator, the charge on the surfaces of the belts due to charging by the belt electrifying device 19 causes dielectric polarization in the print medium 1 which is also constructed from mid/high-resistance body or an insulator. An electrostatic force between the charge resulting from the dielectric polarization and the charge on the belt surface causes the print medium 1 to adhere to the belts. Note that the belt electrifying device 19 for depositing the above-described charge may be a corotron or the like.

Hence, in this inkjet printer the surfaces of the first conveyor belts 6 and the second conveyor belts 7 are charged using the belt electrifying device 19, the print medium 1 is supplied from the gate rollers 14 with the arrangement in the charged state, the print medium 1 is pushed against the first conveyor belts 6 using a paper pressing roller constructed from a spur or roller not shown in the drawings, and the above-described dielectric polarization works to cause the print medium 1 to adhere to the first conveyor belts 6. With the arrangement in this state, the electric motors 11R and 11L rotatably drive the driving rollers 8R and 8L and the resulting rotation driving force is transmitted to the first follower rollers 9R and 9L via the first conveyor belts 6.

With the print medium 1 in the adhered state, printing is performed by moving the first conveyor belts 6 to a downstream side in the conveyed direction, passing the print medium 1 below the first inkjet heads 2, and jetting ink droplets from the nozzles formed in the first inkjet heads 2. When printing by the first inkjet heads 2 has been completed, the print medium 1 is moved downstream in the conveyed direction and transferred onto the second conveyor belts 7 of the second conveyor part 5. Since, as described above, the surfaces of the second conveyor belts 7 are also charged by the belt electrifying device 19, the above-described dielectric polarization works to cause the print medium 1 to adhere to the second conveyor belts 7.

With the arrangement in this state, printing is performed by moving the second conveyor belts 7 downstream in the conveyed direction, passing the print medium 1 below the second inkjet heads 3, and jetting ink droplets from the nozzles formed on the second inkjet heads 3. When printing by the second inkjet heads 3 has been completed, the print medium 1 is moved further downstream in the conveyed direction, separated from the surface of the second conveyor belts 7, and simultaneously expelled into an expelled paper unit.

When the first and second inkjet heads 2 and 3 require cleaning, the above described first and second first cleaning caps 12 and 13 are raised so that the cap bodies adhere the nozzle surfaces of the first and second inkjet heads 2 and 3. With the arrangement in this state, cleaning is performed by negatively pressurizing the cap bodies to suck in ink droplets and bubbles from the nozzles of the first and second inkjet heads 2 and 3, and the first and second cleaning caps 12 and 13 are lowered after a certain period.

Figure 2:
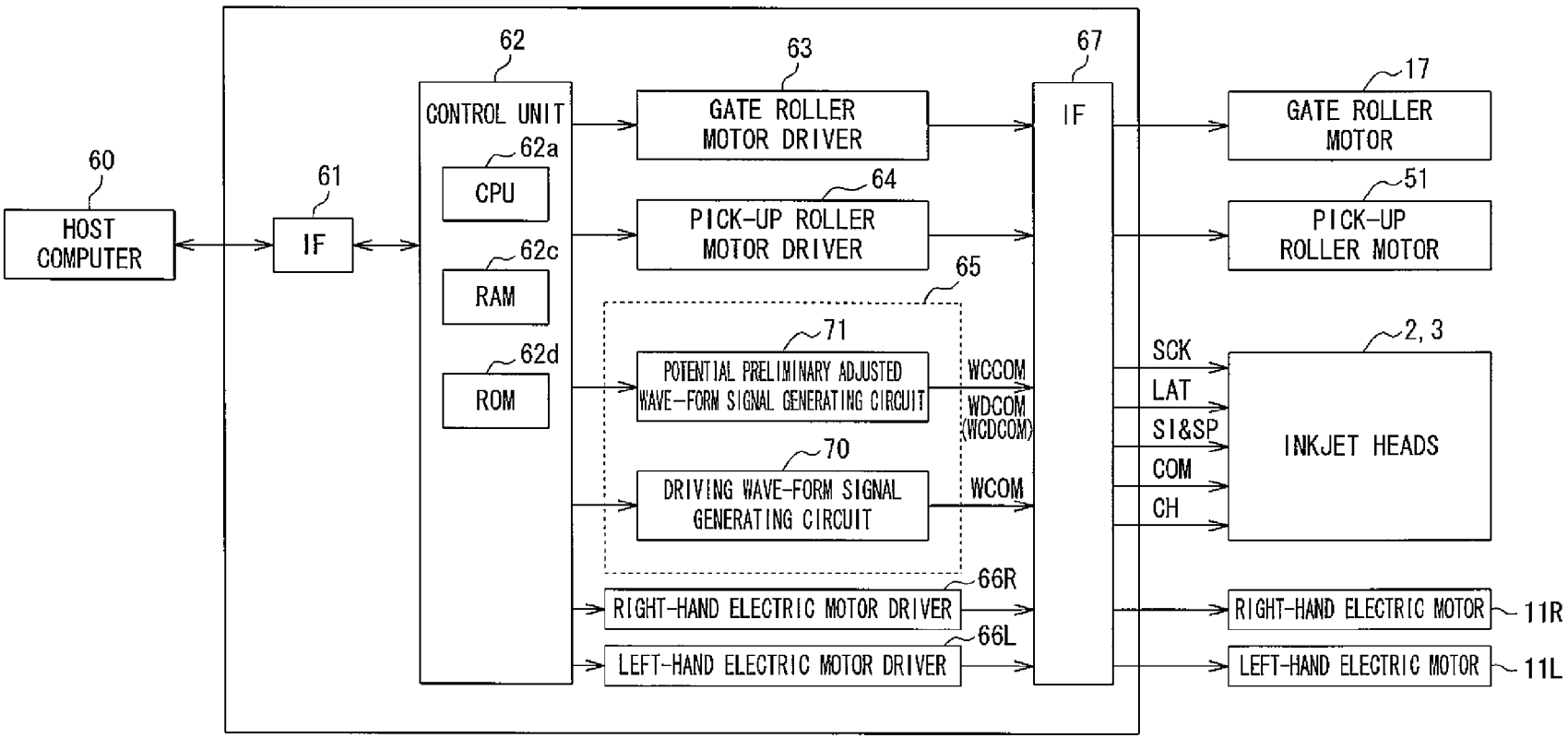
FIG. 2 is a block diagram of a control device of the inkjet printer of FIGS. 1A and 1B.

The inkjet printer includes an internally provided control device. The control device performs print processing on the print medium by controlling a printing device and a paper feeding device based on print data inputted, as shown in FIG. 2 for instance, from a host computer 60 such as a personal computer or a digital camera. The control device includes an input interface unit 61 for receiving print data inputted from the host computer 60, a control unit 62 constructed, for instance, using a microcomputer which executes print processing based on print data inputted from the input interface unit 61, a gate roller motor driver 63 which controls driving of the gate roller motor 17, a pick-up roller motor driver 64 which controls driving of a pick-up roller motor 51 for driving the pick-up roller 16, a head driver 65 which controls driving of the inkjet heads 2 and 3, a right-hand electric motor driver 66R which controls driving of the right-hand electric motor 11R, a left-hand electric motor driver 66L which controls driving of the left-hand electric motor 11L, and an interface unit 67 which converts output signals of the drivers 63 to 65, 66R, and 66L to driving signals for use by the external gate roller motor 17, pick-up roller motor 51, the inkjet heads 2 and 3, the right-hand electric motor 11R, and the left-hand electric motor 11L and outputs the converted signals.

The control unit 62 includes a CPU (Central Processing Unit) 62*a* for executing various processing such as the print processing, RAM (Random Access Memory) 62*c* which temporarily stores various data, such as the print data inputted from the input interface 61 and various data used when executing print processing for the inputted data, or temporarily deploys an application program for the print processing or the like, and ROM (Read Only Memory) 62*d* constructed from non-volatile semiconductor memory and used to store control programs and the like executed by the CPU 62*a*. When print data (image data) is inputted to the control unit 62 from the host computer 60 via the interface unit 61, the CPU 62*a* executes predetermined processing on the input data, and outputs print data (driving signal selection data SI and SP) indicating which nozzles are to jet ink droplets and an amount of ink droplets to be jetted. Based on this print data and input data from various sensors, the CPU 62*a* then outputs control signals to the drivers 63 to 65, 66R, and 66L. After being outputted from the drivers 63 to 65, 66R, and 66L, the control signals are converted by the interface unit 67, and used to supply and convey the print medium 1, control the profile of the print medium 1, and execute printing on the print medium 1, through operation of the actuators corresponding to the plurality of nozzles on the inkjet heads, the gate roller motor 17, the pick-up roller motor 51, the right-hand electric motor 11R, and the left-hand electric motor 11L. Note that the construction elements of the control unit 62 are electrically connected via a bus, which is not shown in the drawings.

Figure 3:
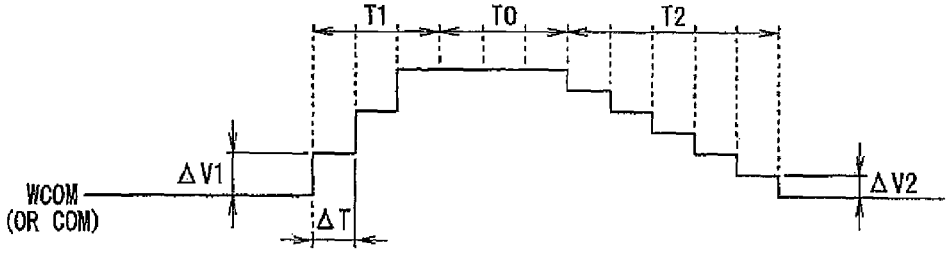
FIG. 3 is a diagram to illustrate driving wave-form generation.
Figure 5:
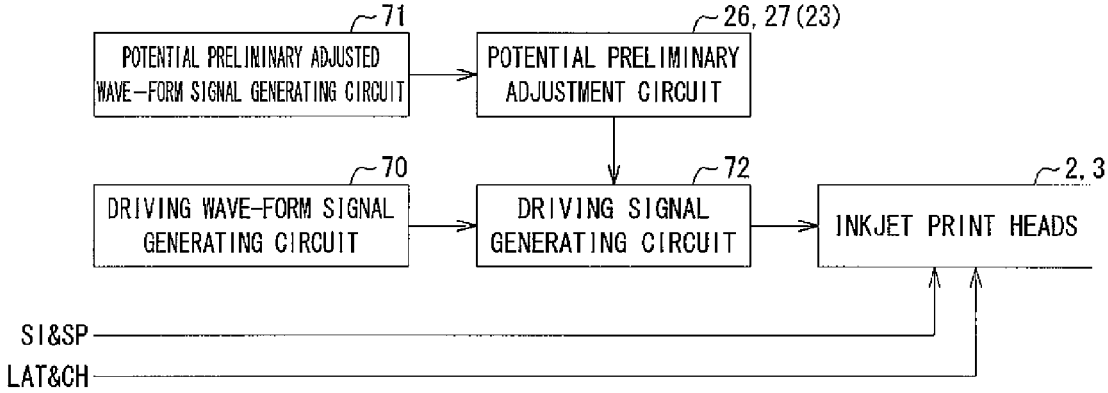
FIG. 5 is a block diagram of a driving signal generating system.

The head driver 65 includes a driving wave-form signal generating circuit 70 which forms a driving wave-form signal WCOM, and a potential preliminary adjusted wave-form signal generating circuit 71 which forms a charging source potential preliminary adjusted wave-form signal WCCOM and a discharging connection potential preliminary adjusted wave-form signal WDCOM. As shown in FIG. 3, the driving wave-form signal generating circuit 70 adds +ΔV1 on the timing of each rising edge of a clock signal to the driving wave-form signal WCOM over a period T1 which lasts until the driving wave-form signal WCOM reaches a middle potential (offset). The driving wave-form signal generating circuit 70 then maintains, over a period T0, a constant value (wave data 0) for the driving wave-form signal WCOM, and reduces, over period T2 the driving wave-form signal WCOM by ΔV2 on the timing of each rising edge of the clock signal. The driving wave-form signal WCOM generated in this way is converted to an analog signal using, for instance, a driving signal generating circuit 72 shown in FIG. 5, electrically amplified, and supplied as a driving signal COM go the inkjet heads 2 and 3. The driving signal COM is used to drive the actuators, each of which is piezoelectric device provided for a corresponding nozzle, thereby enabling each nozzle to jet ink droplets.

A rising portion of the driving signal COM corresponds to a pull-in stage (so called because a meniscus at a jet surface of the ink is pulled in) during which the ink is pulled in by increasing the volume of the cavity (pressure vessel) which communicates with the nozzle, and a falling portion of the driving signal COM corresponds to a push-out stage (so called because the meniscus at the jet surface is pushed-out) during which the ink is pushed out by reducing the volume of the cavity. The push-out results in an ink droplet being jetted from the nozzle. As may be gathered from the above description, the wave forms of the driving signal COM and the driving wave-form signal WCOM can be adjusted using the wave data 0, +ΔV1, −ΔV2, +ΔV3, and the clock signal. The piezoelectric device is a capacitive load and corresponds to a so-called charge-discharge actuator. Therefore, in the present embodiment for instance, charge is caused to flow into the charge-discharge actuator by the rising portion of the driving signal COM, and is discharged from the charge-discharge actuator by the falling portion of the driving signal COM.

Figure 4:
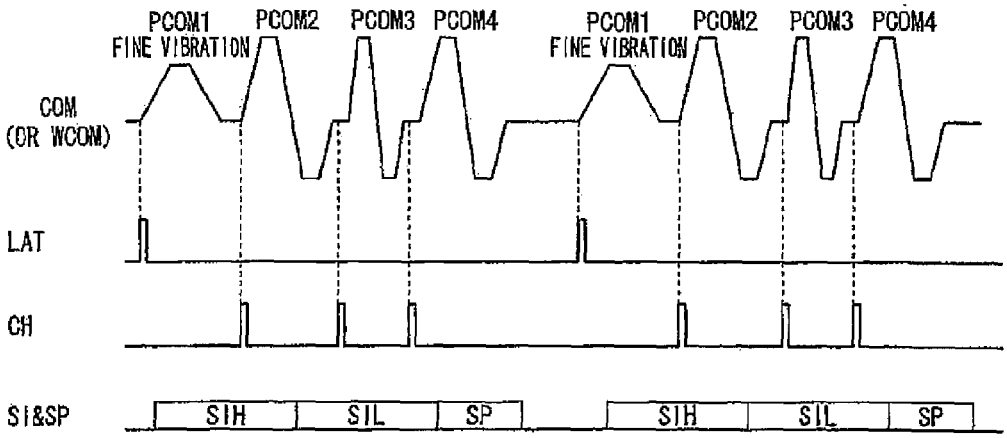
FIG. 4 is a diagram to illustrate a time sequence of linked driving wave-form signals and driving signals.

It is possible to vary an amount of ink pull-in, a rate of ink push-in, an amount of ink push-out, and a rate of ink push-out by varying the voltage rise-and-fall gradients and wave peak values of the driving signal which is a voltage wave form. Consequently, it is possible to vary the amount of ink in the ink droplets and obtain differing sizes for the ink dots. Hence, as shown in FIG. 4 for instance, by generating the driving signal COM using a time sequence of linking consecutive driving pulses PCOM, and jetting a single ink droplet by supplying an actuator 22, which is a piezoelectric device or the like, with an individual driving pulse PCOM selected from the sequence, or jetting a plurality of ink droplets by supplying the actuator 22 with a plurality of pulse selected from the PCOM, it is possible to obtain various ink-dot sizes. In other words, adhering a plurality of ink droplets at a same location before the ink dries is effectively equivalent to jetting a single large ink droplet, and it is therefore possible to increase the size of the ink dots. Arrangements which make use of this technique are capable of multi-gradation. Note that the driving pulse PCOM 1 at the left edge of FIG. 4 only pulls in ink and does not push ink out. This is called a fine vibration and is used, for instance, to prevent or inhibit drying of the nozzle without jetting ink droplets.

As a result of this arrangement, the driving signal COM generated by the driving signal generating circuit 72, the driving signal selection data SI and SP for selecting jet nozzles based on the print data and determining a timing at which to connect the piezoelectric or similar actuator to the driving signal COM, a latch signal LAT and a channel signal CH for connecting the actuator or the inkjet heads 2 and 3 to the driving signal COM based on the driving signal selection data SI and SP after input of nozzle selection data for all the nozzles, and a clock signal SCK to allow transmission of the driving signal selection data SI and SP as serial data to the inkjet heads 2 and 3 are inputted.

Figure 6:
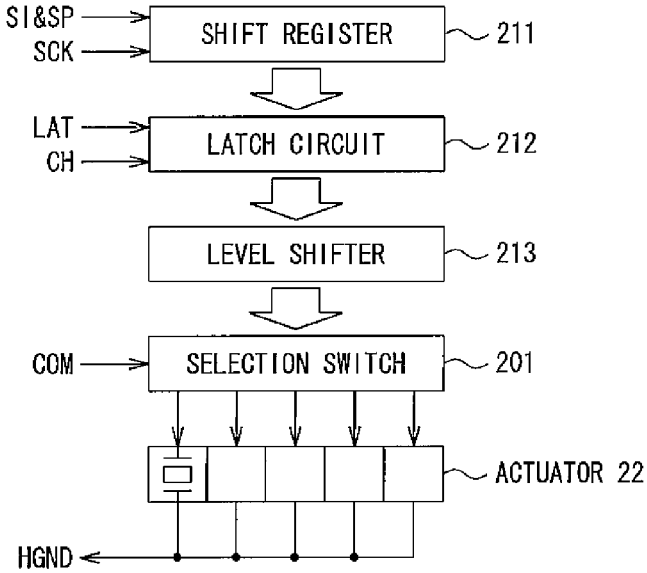
FIG. 6 is a block diagram of a selection unit which connects the driving signal to an actuator.

The following describes a configuration for connecting the piezoelectric or similar actuator to the driving signal COM outputted from the driving signal generating circuit. FIG. 6 is a block diagram showing a selecting unit for connecting the driving signal COM to the piezoelectric or similar actuator. The selecting unit is constructed using a shift register 211 which stores driving signal selection data SI and SP for specifying the piezoelectric or similar actuator corresponding to the nozzle from which ink is to be jetted, a latch circuit 212 which temporarily stores data of the shift register 211, a level shifter 213 which performs level conversion on an output of the latch circuit 212, a selection switch 201 which connects the driving signal COM to the piezoelectric or similar actuator 22 according to an output of the level shifter 213.

The driving signal selection data signals SI and SP are sequentially inputted to the shift register 211, and the storage region therein is sequentially shifted from an initial stage in response to input pulses of the-clock signal SCK. After the driving signal selection data SI and SP for a certain number of nozzles has been stored in the shift register 211, the latch circuit 212 latches the output signal of the shift register 211 using the inputted latch signal LAT. The signal stored in the latch circuit 212 is converted to voltage level which can switch the selection switch 201 of the following stage on and off depending on the level shifter 213. This is because the voltage of the driving signal COM is high compared to the output voltage of the latch circuit 212 and the operating voltage range of the selection switch 201 is set to a correspondingly high level. Hence, as a result of the selection switch 201 being closed by the level shifter 213, the piezoelectric or similar actuator is connected to the driving signal COM at a connection timing of the driving signal selection data SI and SP. After the driving signal selection data SI and SP of the shift register 211 have been stored by the latch circuit 212, a next piece of print information is inputted to the shift register 211, and the data stored by the latch circuit 212 is thereby sequentially updated in accordance with a jet timing of the ink droplets. It is to be noted that the symbol HGND in FIG. 6 denotes a ground terminal of the actuator. Also, after the selection switch 201 has disconnected the piezoelectric or similar actuator from the driving signal COM, the input voltage to the actuator 22 is maintained at a same level as directly before disconnection.

In order to electrically amplify the driving signal COM as described above with reference to FIG. 5, a charge-use transistor and a discharge-use transistor are connected between the power source and earth in a later-described push-pull configuration. The transistor pair connected in the push-pull configuration provides a drive which is linearly dependent on the driving wave-form signal WCOM. The product of the potential difference between the driving signal for charging the piezoelectric or similar charge-discharge actuator driving signal and the power source potential (charging source potential), or the potential difference between the driving signal for discharging from the charge-discharge actuator and the earth potential (discharging connection potential) multiplied by a current value is the consumed electrical power. As described above, the consumed electrical power is mainly dissipated as heat. Thus, if the above described potential differences are large, the amount of power consumed and the amount of generated heat will increase accordingly. Therefore, in the present embodiment, the charging source potential to the driving signal generating circuit 72 and the discharging connection potential from the driving signal generating circuit 72 are adjusted using the potential preliminary adjustment circuits 26 and 27, based on the charging source potential preliminary adjusted wave-form signal WCCOM and the discharging connection potential preliminary adjusted wave-form signal WDCOM generated by the potential preliminary adjusted wave-form signal generating circuit 71. These adjustments reduce the potential difference between the driving signal and the charging source potential for charging the charge-discharge actuator or the potential difference between the driving signal for discharging the charge-discharge actuator and the discharging connection potential, and thereby reduce the amount of electrical power consumed and heat generated. The driving signal generating circuit 72 and the potential preliminary adjustment circuits 26 and 27 are constructed within the interface unit 67.

Figure 7:
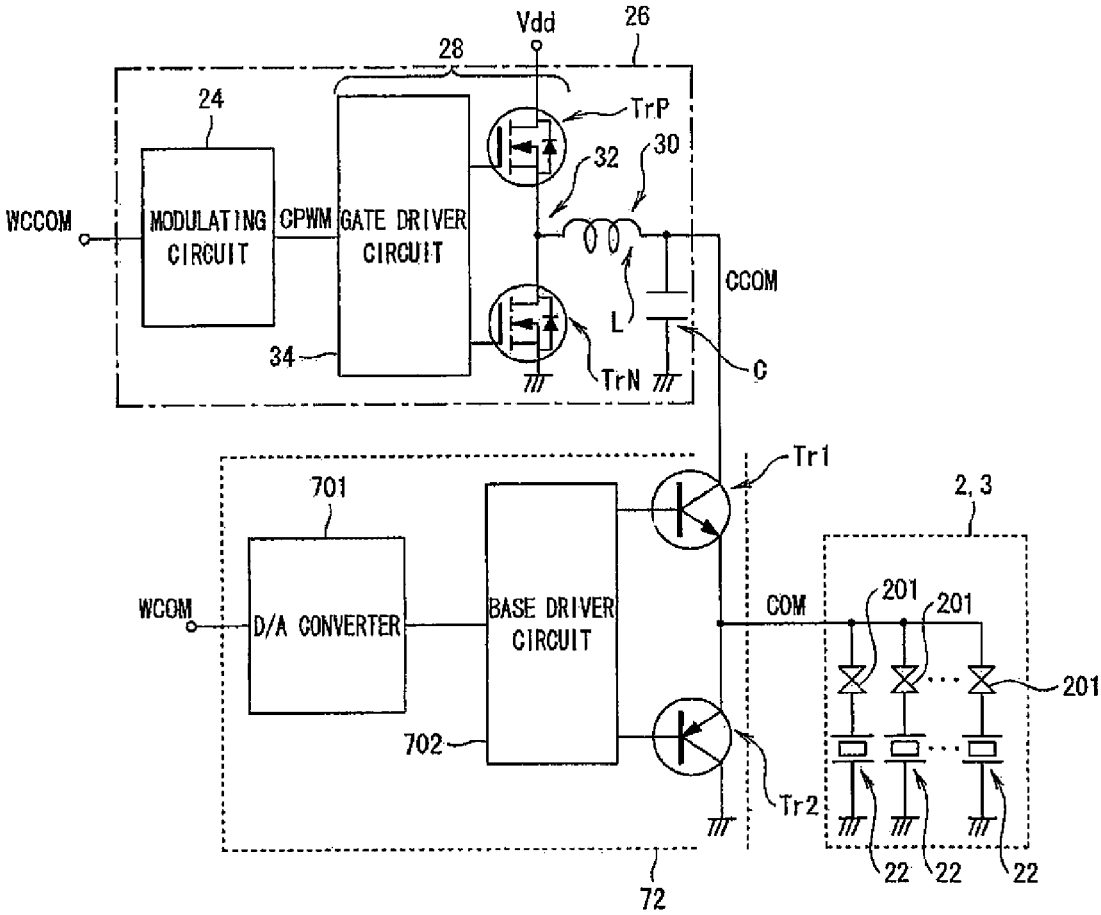
FIG. 7 is a block diagram showing details of a driving signal generating circuit and a potential preliminary adjustment circuit of the driving signal generating system of FIG. 5.

FIG. 7 shows a specific example of circuit constructions for the potential preliminary adjustment circuit 26 and the driving signal generating circuit 72 of the present embodiment. The present embodiment only provides the charging source potential preliminary adjustment circuit 26 which makes a preliminary adjustment to the charging source potential for the driving signal generating circuit 72. In the present embodiment, the driving signal generating circuit 72 is substantially the same as the circuit disclosed in JP-A-2004-306434, and includes a charge-use transistor Tr1 and a discharge use transistor Tr2 connected in a push-pull configuration, a D/A converter 701 which converts the digital driving wave-form signal WCOM to an analog signal, and a base driver circuit 702 which controls the base voltages of the two transistors Tr1 and Tr2 according to the analog driving wave-form signal WCOM resulting from the D/A conversion. The charging source potential preliminary adjusted signal CCOM from the charging source potential preliminary adjustment circuit 26 is supplied to the collector of the NPN-type charge-use transistor Tr1 of the two transistors Tr1 and Tr2. The emitter of the NPN-type charge-use transistor Tr1 is connected to an input side of the selection switch 201, and the base is connected to one of the outputs of the base driver circuit 702. The emitter of the PNP-type discharge-use transistor Tr2 is connected to an input side of the selection switch 201, the collector is connected to ground, and the base is connected to the other output of the base driver circuit 702. In the transistor pair, the charge-use transistor Tr1 supplies the actuator 22, which is a capacitive load, with charge using the charging source potential preliminary adjusted signal CCOM whose voltage wave form is dependent on a driving pulse COM, via the selection switch 201, thereby charging the actuator 22. The other discharge used transistor Tr2 discharges the actuator 22, which is a capacitive load, using a voltage wave-form dependent on the driving pulse COM, via the selection switch 201.

The charging source potential preliminary adjustment circuit 26 includes a charging source potential modulating circuit 24 for pulse modulation of the charging source potential preliminary adjusted wave-form signal WCCOM generated in a similar way to the above-described driving wave-form signal WCOM, a so-called class-D amplifier 28 which is a charging source potential digital power amplifier for power amplifying a charging source potential modulated signal CPWM resulting from pulse modulation by the charging source potential modulating circuit 24, and a charging source potential ripple filter 30 which smoothes the charging source potential preliminary adjusted signal CCOM resulting from the power amplification by the charging source potential digital power amplifier 28 and outputs the signal to the collector of the charge-use transistor Tr1 of the driving signal generating circuit 72.

The charging source potential modulating circuit 24 for pulse modulating the charging source potential preliminary adjusted wave-form signal WCCOM makes use of a regular pulse width modulation (PWM) circuit. The charging source potential modulating circuit 24 of FIG. 7 includes a generally known triangle wave oscillator, and a comparator for comparing the triangular wave-form signal outputted by the triangular wave oscillator with the charging source potential preliminary adjusted wave-form signal WCCOM. The charging source potential modulating circuit 24 causes the modulated signal, which is a so-called PWM signal, to be outputted as Hi when, for instance, the charging source potential preliminary adjusted wave-form signal WCCOM is greater than or equal to the triangle wave-form signal and as Lo when the charging source potential preliminary adjusted wave-form signal WCCOM is less than the triangle wave-form signal. Note also that, in the present embodiment, a pulse width modulation circuit is used for the pulse modulation circuit, but a pulse density modulation circuit (PDM) may be used in place of the pulse width modulation circuit.

Figure 8:
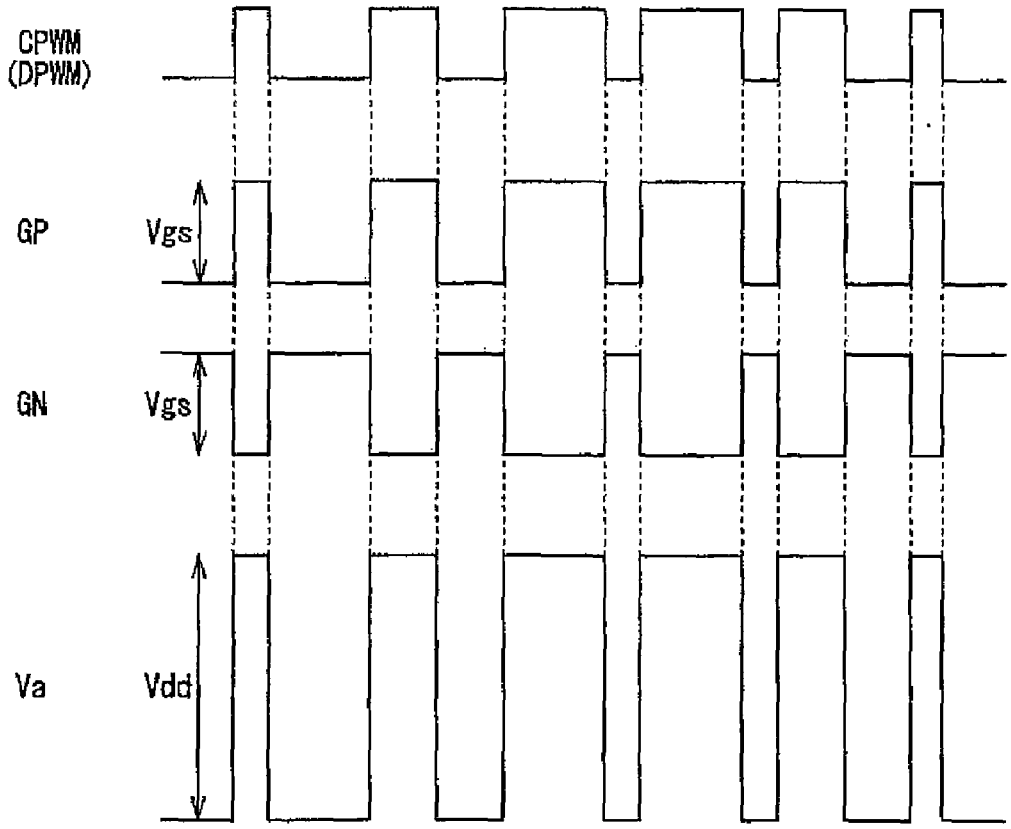
FIG. 8 is a diagram illustrating operations a digital power amplifier of the potential preliminary adjusting circuit of FIG. 7.

The charging source potential digital power amplifier 28, which is a so-called class-D amplifier, includes a charging source potential transistor pair 32 made up of two MOSFET transistors TrP and TrN for substantially electrically amplifying and generally called a charging source potential transistor pair and a gate driver circuit 34 for adjusting the gate-source signals GP and GN of the MOSFETs TrP and TrN based on the charging source potential modulated signal CPWM from the charging source potential modulating circuit 24. The charging source potential transistor pair 32 is arranged in a push-pull configuration with the MOSFET TrP on the high side and the MOSFET TrN on the low side. In this arrangement, the gate-source signal of the high-side MOS- FET TrP is denoted GP, the gate-source signal of the low-side MOSFET TrN is denoted GN, and the output of the charging source potential transistor pair 32 is denoted Va, and the variation of signal signals in response to the charging source potential modulated signal CPWM is shown in FIG. 8. Note also that the output characteristics are the same as a discharging connection potential transistor pair 33 which power amplifies a discharging connection potential modulated signal DPWM which is described later.

In the present embodiment, when for instance the charging source potential modulated signal CPWM is Hi, the gate-source signal GP of the high-side MOSFET TrP is Hi, and the gate-source signal GN of the low-side MOSFET is Lo. The high-side MOSFET TrP is therefore in an ON state and the low-side MOSFETT TrN is in an OFF state. Consequently, the output Va of the charging source potential transistor pair 32 is the charging source potential Vdd or the like. On the other hand, when the charging source potential modulated signal CPWM is Lo, the gate-source signal GP of the high-side MOSFET TrP is Lo, and the gate-source signal GN of the low-side MOSFET is Hi. The high-side MOSFET TrP is therefore in an OFF state and the low-side MOSFETT TrN is in an ON state. Consequently, the output Va of the charging source potential transistor pair 32 is zero.

The output Va of the charging source potential transistor pair 32 of the charging source potential digital power amplifier 28 is supplied to the collector of the charge-use transistor Tr1 of the driving signal generating circuit 72 via a charging source potential ripple filter 30 as the charging source potential preliminary adjusted signal CCOM. The charging source potential ripple filter 30 is constructed using an LC low-pass filter which, for instance, includes a combination of a single coil L and a single capacitor C. The charging source potential ripple filter 30 made up of the low-pass filter is designed to remove high frequency components of the output Va of the charging source potential transistor pair 32 of the charging source potential digital power amplifier 28, and thereby sufficiently attenuate the carrier signal of the pulse modulation without attenuating the charging source potential preliminary adjusted signal CCOM.

In the present embodiment, the potential of the charging source potential preliminary adjusted signal CCOM supplied to the collector of the charge-use transistor Tr1 of the driving signal generating circuit 72 is adjusted to be slightly higher than the driving signal COM by setting the charging source potential preliminary adjusted wave-form signal WCCOM appropriately. Two methods exist for adjusting the potential of the charging source potential preliminary adjusted signal CCOM. In the plot shown in FIG. 9A, for instance, the actual voltage value of the charging source potential preliminary adjusted signal CCOM has been adjusted to be slightly higher than the potential of the driving signal COM. In the plot shown in FIG. 9B, the potential of the charging source potential preliminary adjusted signal CCOM has been adjusted to be slightly higher than the potential of the driving signal COM by making the phase of the charging source potential preliminary adjusted signal CCOM earlier than that of the driving signal COM.

Figure 9A:
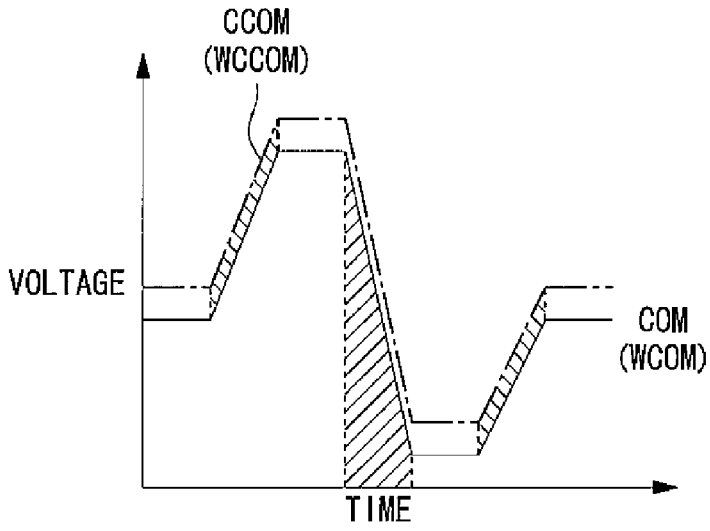
FIGS. 9A and 9B are diagrams illustrating operations of the driving signal generating system of FIG. 7.
Figure 9B:
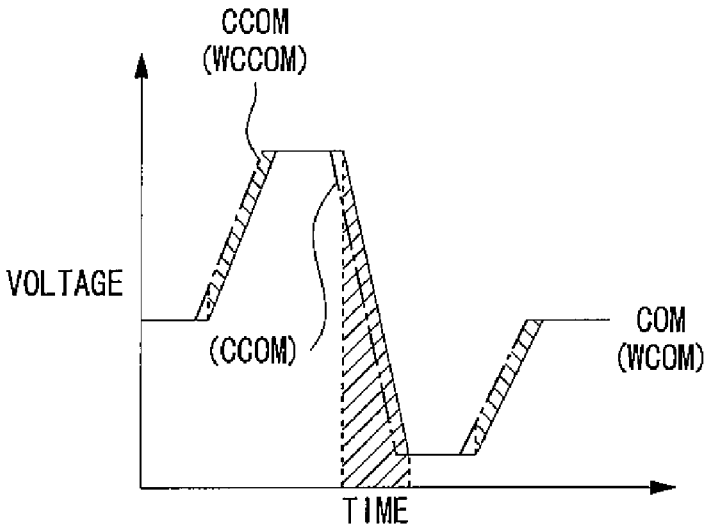
Figure 10A:
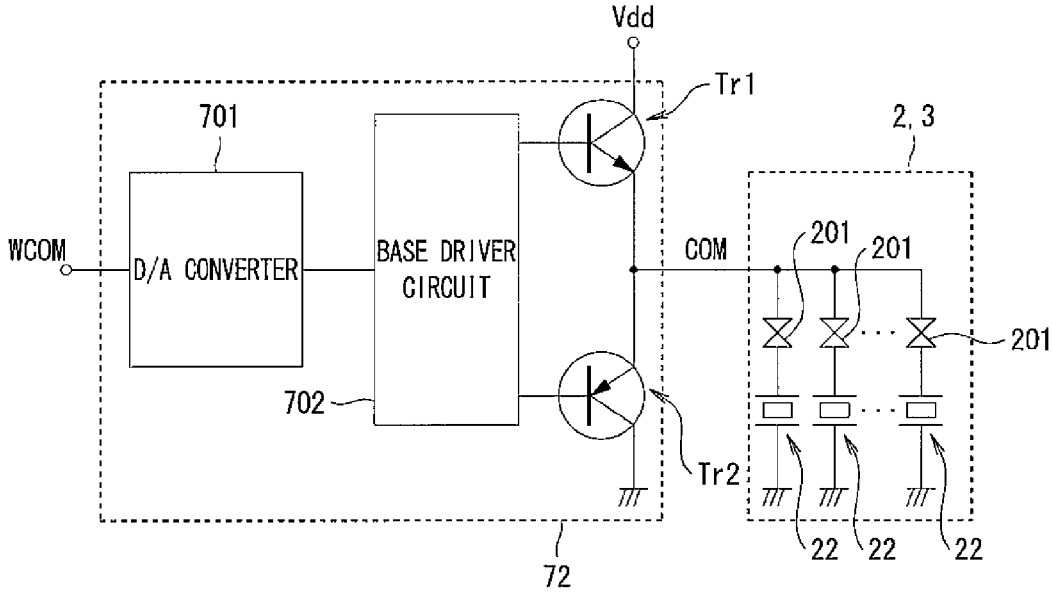
FIGS. 10A and 10B include a block diagram of a conventional driving signal generating system and a diagram illustrating operations of the conventional driving signal generating system.
Figure 10B:
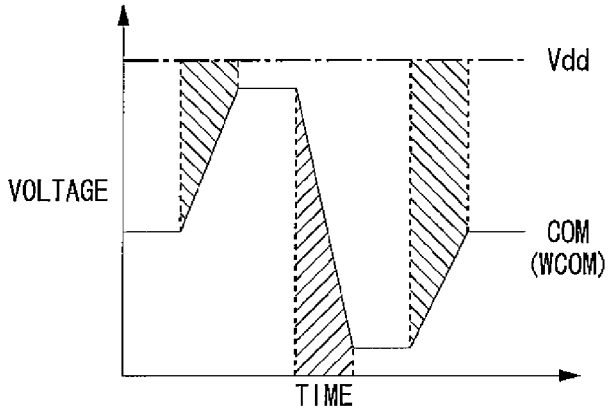

In the present embodiment, the hatched sections in FIGS. 9A and 93 correspond to power consumptions. In the present embodiment, since preliminary adjustment is not applied to the discharging connection potential, there is no change in the power consumption resulting from the potential difference between the driving signal COM and the discharging connection potential (i.e. ground potential). However, because the potential of the charging source potential preliminary adjusted signal CCOM supplied to the collector of the charge-use transistor Tr1 of the driving signal generating circuit 72, is adjusted to be only slightly higher than the driving signal COM, the power consumption due to the potential difference between the two is small. FIG. 10A shows the conventional inkjet printer of JP-A-2004-306434 in which there is no charging source potential preliminary adjustment circuit 26 and a charging source potential Vdd is supplied in an unaltered form to the charge-use transistor Tr1 of the driving signal generating circuit 72. In FIG. 10B, as in FIGS. 9A and 9B, the hatched sections show the power consumption. To aid understanding the symbols in FIGS. 10A and 10B are the same as the symbols used in the embodiment. In the diagrams showing power consumption, it is clear that the potential difference between the charging source potential Vdd and the driving signal COM is large compared to the present embodiment in which the charging source potential undergoes a preliminary adjustment, and it follows that the power consumption is higher. Since a higher power consumption equates to more heat, it is necessary to increase a size and heat resistance of the employed transistors, provide a heat sink to actively release heat. In contrast, since the present embodiment allows power consumption to be lowered and the amount of generated heat to be reduced in comparison to the conventional inkjet printer, such measures are unnecessary. Moreover, the preliminary adjustment, through power amplification by the charging source potential digital power amplifier 28 made up of the charging source potential transistor pair 32, of the charging source potential preliminary adjusted signal CCOM supplied to the collector of the charge-use transistor Tr1 of the driving signal generating circuit 72 makes it possible to accurately adjust the potential of the charging source potential preliminary adjusted signal CCOM.

Thus, according to the present embodiment, in order to generate the driving wave-form signal WCOM as a basis of a signal for controlling a driving state of the actuator 22 using the driving wave-form signal generating circuit 70 and output a driving signal. COM by amplifying the generated driving wave-form signal WCOM using the charge-use transistor Tr1 and the discharge-use transistor Tr2 connected in a push-pull configuration in the driving signal generating circuit 72, the inkjet printer generates the charging source potential preliminary adjustment wave-form signal WCCOM for making a preliminary adjustment to the charging source potential for the driving signal generating circuit 72, performs pulse modulation of the charging source potential preliminary adjustment wave-form signal WCCOM using the charging source potential modulating circuit 24, electrically amplifies the pulse-modulated charging source potential modulated signal CPWM using the charging source potential transistor pair 32 connected in a push-pull configuration in the charging source potential digital amplifier 28, smoothes the electrically amplified charging source potential preliminary adjusted signal CCOM using the charging source potential ripple filter 30, and outputs the result to the collector of the charge-use transistor Tr1 of the driving signal generating circuit 72. As a result, it is possible to reduce the potential difference between the charging source potential preliminary adjusted signal CCOM and the driving signal COM for charging the charge-discharge actuator, and thereby reduce power consumption.

Further, if the charging source potential preliminary adjusted wave-form signal WCCOM for adjusting the potential of the charging source potential preliminary adjusted signal CCOM is generated by adjusting the voltage values of the charging source potential preliminary adjusted signal CCOM, accuracy of the driving signal COM can be improved and a further reduction in power consumption is possible.

Moreover, if the charging source potential preliminary adjusted wave-form signal WCCOM for adjusting the potential of the charging source potential preliminary adjusted signal CCOM is generated by adjusting the phase of the charging source potential preliminary adjusted signal CCOM, accuracy of the driving signal COM can be improved and a further reduction in power consumption is possible.

Figure 11:
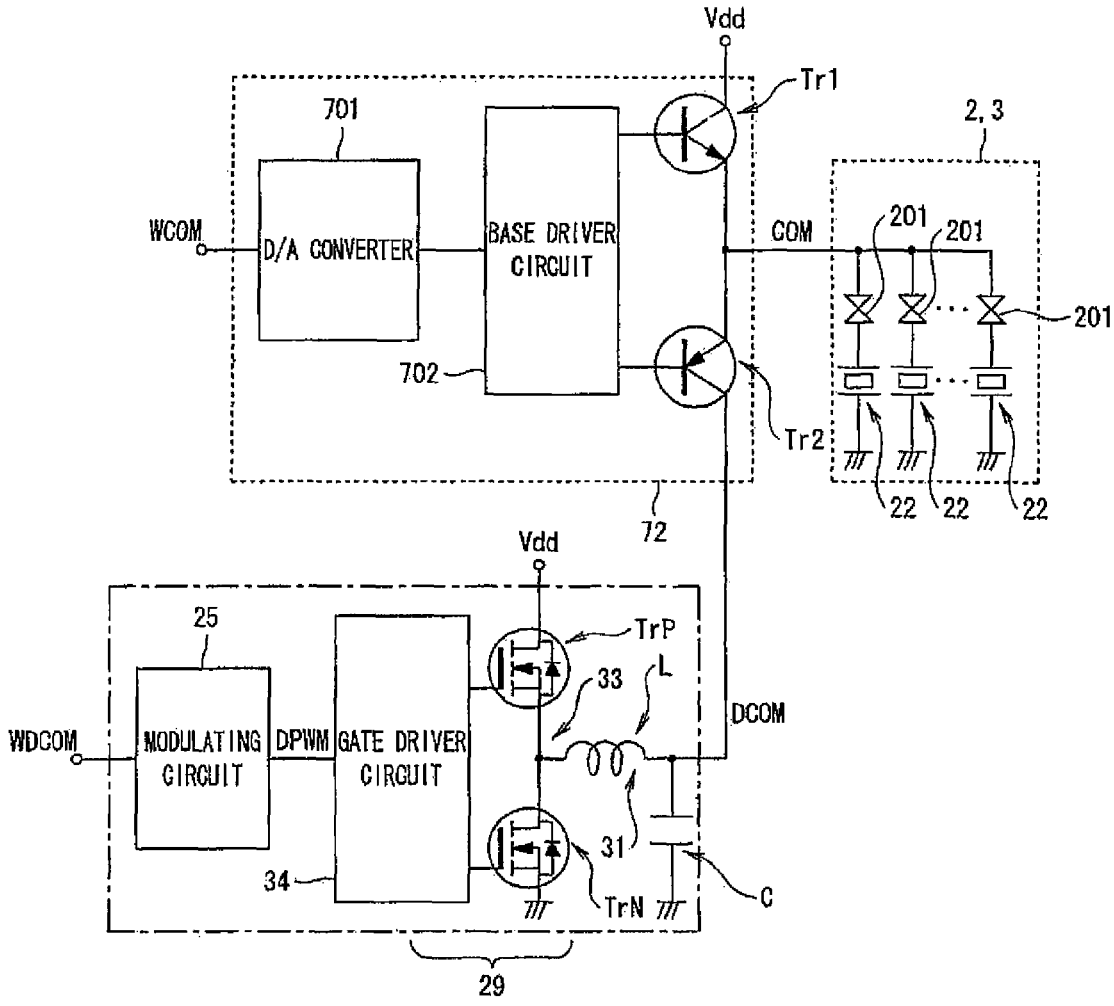
FIG. 11 is a block diagram of a driving signal generating system of a second embodiment of the inkjet printer to which the liquid jetting device of the present invention has been applied.

The following describes, with reference to FIG. 11, a second embodiment of the inkjet printer of the present invention. In the present embodiment, the conceptual construction and control device of the inkjet printer, the methods for generating the driving wave-form signals and the driving signals, and the construction of the actuator selection circuits are the same as those in the first embodiment. In the present embodiment, however, a discharging connection potential preliminary adjustment circuit 27 is provided in place of the charging source potential preliminary adjustment circuit 26 of the first embodiment. The discharging connection potential preliminary adjustment circuit 27 is connected to the collector of the discharge-use transistor Tr2 of the driving signal generating circuit 72 and makes a preliminary adjustment to the potential of the discharging connection for the discharge-use transistor Tr2. Note that the collector of the charge-use transistor Tr1 of the driving signal generating circuit 72 is connected to a charging source potential Vdd.

The discharging connection potential preliminary adjustment circuit 27 includes a discharging connection potential modulating circuit 25 for pulse modulation of the discharge potential preliminary adjusted wave-form signal WDCOM generated in a similar way to the above-described driving wave-form signal WCOM, a so-called class-D amplifier 29 which is a discharging connection potential digital power amplifier for electrically amplifying a discharging connection potential modulated signal DPWM resulting from pulse modulation by the discharging connection potential modulating circuit 25, and a discharging connection potential ripple filter 31 which smoothes the discharging connection potential preliminary adjusted signal DCOM resulting from the power amplification by the discharging connection potential digital power amplifier 29 and outputs the signal to the collector of the discharge-use transistor Tr2 of the driving signal generating circuit 72.

The discharging connection potential modulating circuit 25 for pulse modulation of the discharging connection potential preliminary adjusted wave-form signal WDCOM makes use of a regular pulse width modulation (PWM) circuit in the same way as the charging source potential modulating circuit 24 of the first embodiment. The discharging connection potential digital power amplifier 29, which is a so-called class-D amplifier, includes a discharging connection potential transistor pair 33 made up of two MOSFET transistors TrP and TrN for substantially amplifying electrical power in the same way as the charging source potential digital power amplifier 28 of the first embodiment, and a gate driver circuit 34 for adjusting the gate-source signals GP and GN of the MOSFETs TrP and TrN based on the discharging connection potential modulated signal DPWM from the discharging connection potential modulating circuit 25. The discharging connection potential ripple filter 31 is constructed using an LC low-pass filter which, like the charging source potential ripple filter 30 of the first embodiment, may include a combination of a single coil L and a single capacitor C.

In the present embodiment, the potential of the discharging connection potential preliminary adjusted signal DCOM supplied to the collector of the discharge-use transistor Tr2 of the driving signal generating circuit 72 is adjusted to be slightly lower than the driving signal COM by setting the discharging connection potential preliminary adjusted wave-form signal WDCOM appropriately. There are two methods for adjusting the potential of the discharging connection potential preliminary adjusted signal DCOM. In the plot shown in FIG. 12A, for instance, the actual voltage value of the discharging connection potential preliminary adjusted signal DCOM has been adjusted to be slightly lower than the potential of the driving signal COM. In the plot shown in FIG. 12B, the potential of the discharging connection potential preliminary adjusted signal DCOM has been adjusted to be slightly lower than the potential of the driving signal COM by making the phase of the discharging connection potential preliminary adjusted signal DCOM earlier than that of the driving signal COM.

Figure 12A:
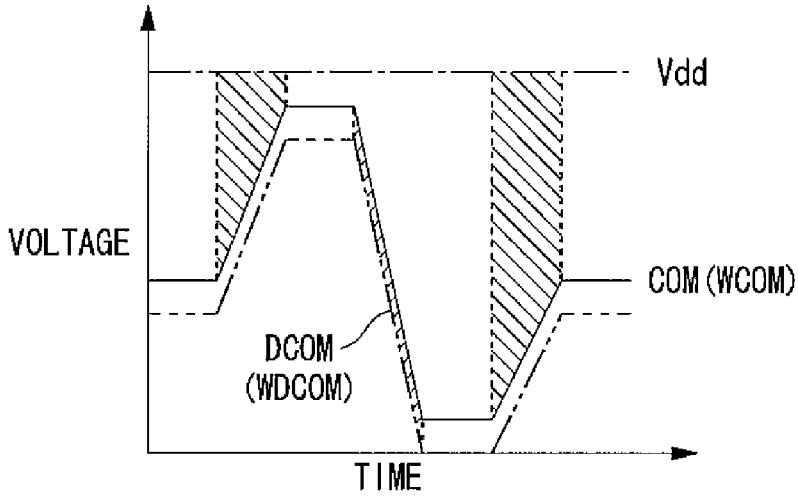
FIGS. 12A and 12B are diagrams illustrating operations of the driving signal generating system of FIG. 11.
Figure 12B:
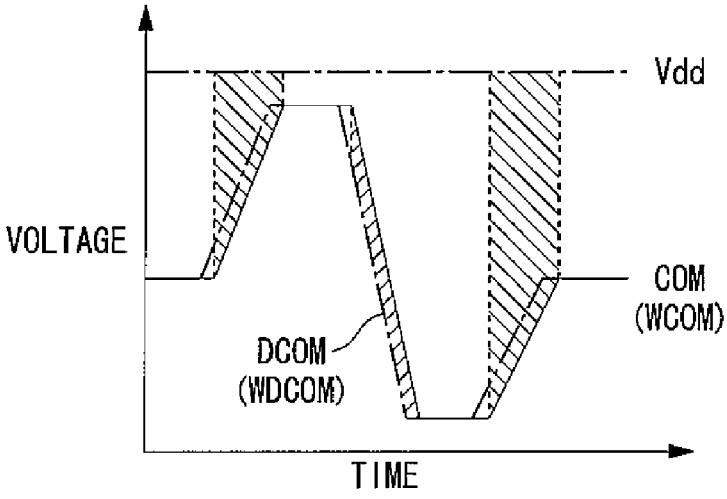

In the present embodiment, the hatched sections in FIGS. 12A and 12B correspond to power consumptions. In the present embodiment, since no preliminary adjustment is made to the charging source potential, there is no change in the power consumption resulting from the potential difference between the driving signal COM and the charging source potential Vdd. However, since the potential of the discharging connection potential preliminary adjusted signal DCOM supplied to the collector of the discharge-use transistor Tr2 of the driving signal generating circuit 72 is adjusted to be slightly lower than that of the driving signal COM the power consumption resulting from the potential difference between the two is small. Thus, since the present embodiment allows the power consumption to be lowered and the amount of generated heat to be reduced in comparison to the conventional inkjet printer, measures for dealing with the generated heat are not required. Moreover, the preliminary adjustment, through power amplification by the discharging connection potential digital power amplifier 29 made up of the discharging connection potential transistor pair 33, of the discharging connection potential preliminary adjusted signal DCOM supplied to the collector of the discharge-use transistor Tr2 of the driving signal generating circuit 72 makes it possible to accurately adjust the potential of the discharging connection potential preliminary adjusted signal DCOM.

Thus, according to the present embodiment, in order to generate the driving wave-form signal WCOM as a basis of a signal for controlling a driving state of the actuator 22 using the driving wave-form signal generating circuit 70 and output a driving signal COM by amplifying the generated driving wave-form signal WCOM using the charge-use transistor Tr1 and the discharge-use transistor Tr2 connected in a push-pull configuration in the driving signal generating circuit 72, the inkjet printer generates the discharging connection potential preliminary adjustment wave-form signal WDCOM for making a preliminary adjustment to the potential of a discharging connection for the driving signal generating circuit 72, performs pulse modulation of the discharging connection potential preliminary adjustment wave-form signal WDCOM using the discharging connection potential modulating circuit 25, electrically amplifies the pulse-modulated discharging connection potential modulated signal DPWM using the discharging connection potential transistor pair 33 connected in a push-pull configuration in the discharging connection potential digital amplifier 29, smoothes the amplified discharging connection potential preliminary adjusted signal DCOM using the discharging connection potential ripple filter 31, and outputs the result to the collector of the discharge-use transistor Tr2 of the driving signal generating circuit 72. As a result, it is possible to reduce the potential difference between the discharging connection potential preliminary adjusted signal DCOM and the driving signal COM for discharging the charge-discharge actuator 22, and thereby reduce power consumption.

Further, if the discharging connection potential preliminary adjusted wave-form signal WDCOM for adjusting the potential of the discharging connection potential preliminary adjusted signal DCOM is generated by adjusting the voltage values of the discharging connection potential preliminary adjusted signal DCOM, accuracy of the driving signal COM can be improved and a further reduction in power consumption is possible.

Moreover, if the discharging connection potential preliminary adjusted wave-form signal WDCOM for adjusting the potential of the discharging connection potential preliminary adjusted signal DCOM is generated by adjusting the phase of the charging source potential preliminary adjusted signal DCOM, accuracy of the driving signal COM can be improved and a further reduction in power consumption is possible.

Figure 13:
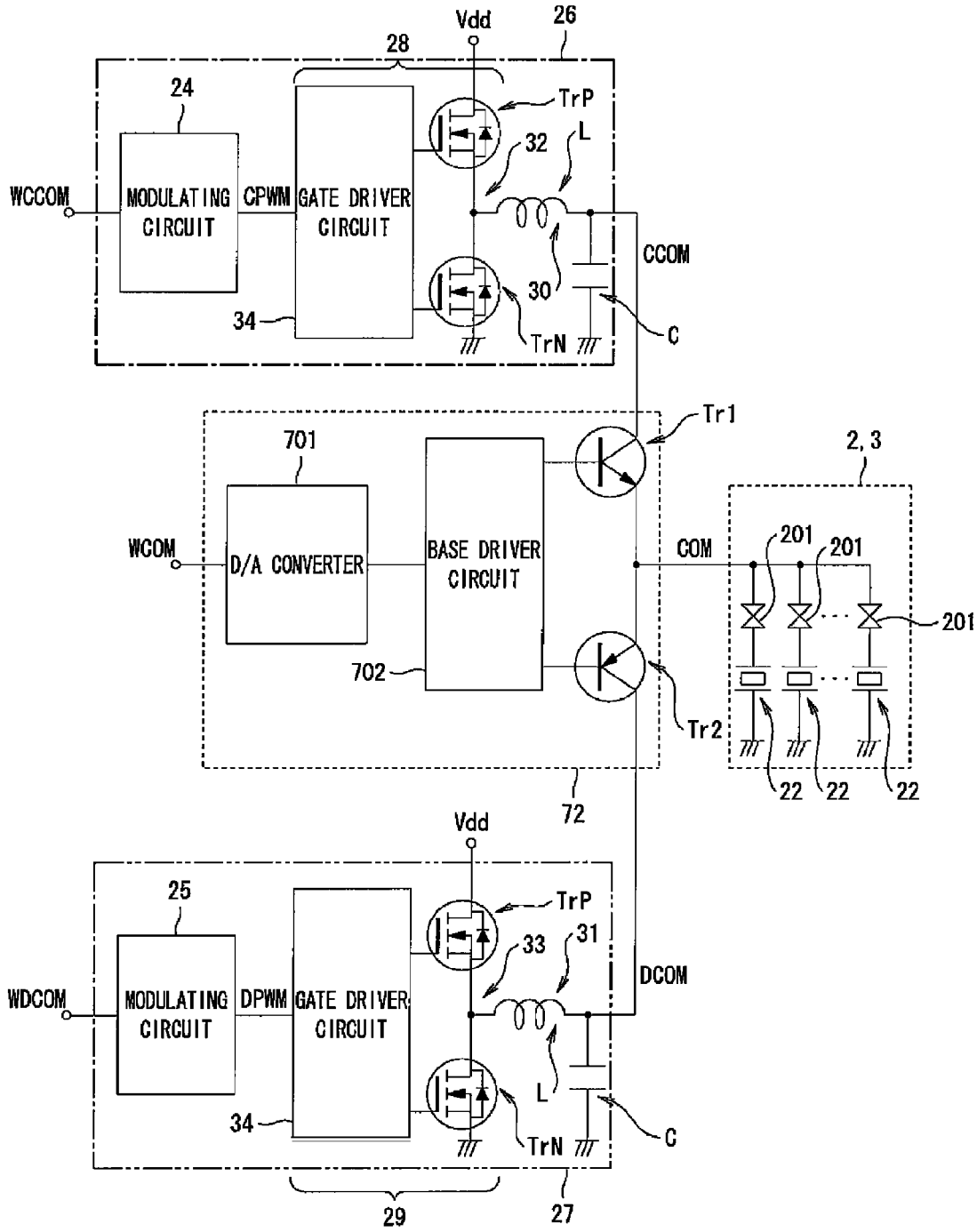
FIG. 13 is a block diagram of a driving signal generating system of a third embodiment of the inkjet printer to which the liquid jetting device of the present invention has been applied.

The following describes a third embodiment of the inkjet printer of the present invention with reference to FIG. 13. In the present embodiment, the conceptual construction and control device of the inkjet printer, the methods for generating the driving wave-form signals and the driving signals, and the construction of the actuator selection circuits are the same as those in the first embodiment. In the present embodiment, however, the charging source potential preliminary adjustment circuit 26 of the first embodiment is provided together with the discharging connection potential preliminary adjustment circuit 27 of the second embodiment. Since the constructions and functions of these circuits are the same as the corresponding circuits of the first embodiment and the second embodiment, similar construction elements are denoted using the same symbols, and detailed descriptions of these construction elements have been omitted.

In the present embodiment, the potential of the charging source potential preliminary adjusted signal CCOM supplied to the collector of the charge-use transistor Tr1 of the driving signal generating circuit 72 is adjusted to be slightly higher than that of the driving signal COM by setting the charging source potential preliminary adjusted wave-form signal WCCOM appropriately, and the potential of the discharging connection potential preliminary adjusted signal DCOM supplied to the collector of the discharge-use transistor Tr2 of the driving signal generating circuit 72 is adjusted to be slightly lower than that of the driving signal COM by setting the discharging connection potential preliminary adjusted wave-form signal WDCOM appropriately. Two methods exist for adjusting the potential of the charging source potential adjusted signal CCOM. In the plot shown in FIG. 14A, for instance, the actual voltage value of the charging source potential preliminary adjusted signal CCOM has been adjusted to be slightly higher than the potential of the driving signal driving signal COM. In the plot shown in FIG. 14B, the potential of the charging source potential adjusted signal CCOM has been adjusted to be slightly higher than the potential of the driving signal COM by making the phase of the charging source potential preliminary adjusted signal CCOM earlier than that of the driving signal COM. There are also two methods for adjusting the potential of the discharging source potential preliminary adjusted signal DCOM. In the plot shown in FIG. 14A, for instance, the actual voltage value of the discharging connection potential preliminary adjusted signal DCOM has been adjusted to be slightly lower than the potential of the driving signal driving signal COM. In the plot shown in FIG. 14B, the potential of the discharging connection potential preliminary adjusted signal DCOM has been adjusted to be slightly lower than the potential of the driving signal COM by making the phase of the discharging connection potential preliminary adjusted signal DCOM earlier than that of the driving signal COM.

Figure 14A:
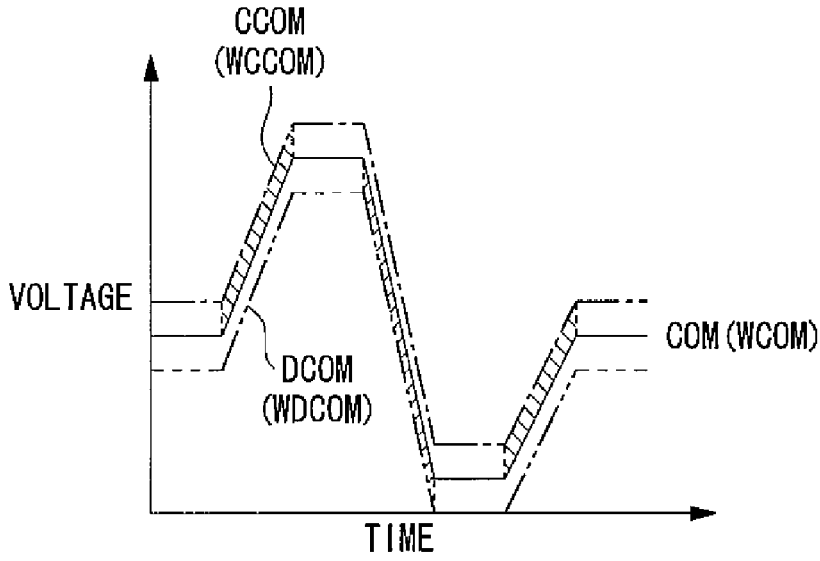
FIGS. 14A and 14B are diagrams illustrating operations of the driving signal generating system of FIG.
Figure 14B:
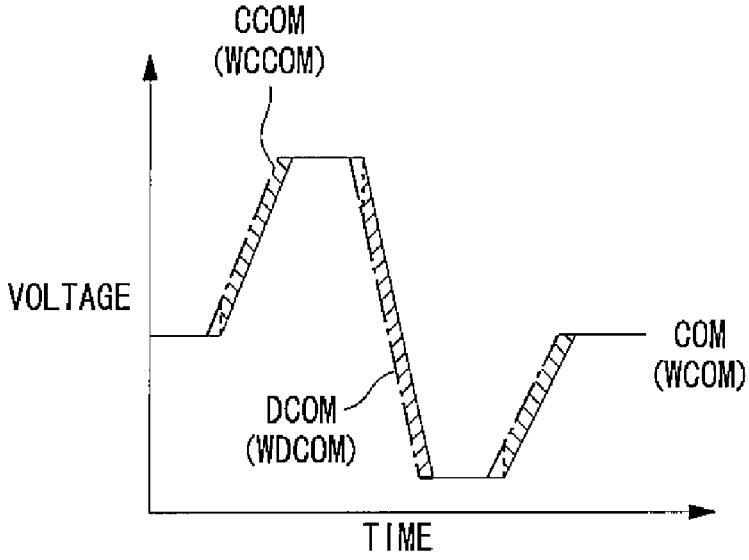

In the present embodiment, the hatched sections in FIGS. 14A and 14B correspond to power consumptions. In the present embodiment, since potential of the charging source potential preliminary adjusted signal CCOM supplied to the collector of the charge-use transistor Tr1 of the driving signal generating circuit 72 is adjusted to be slightly higher than that of the potential of the driving signal COM, the power consumption resulting from the potential difference between the two is small. Moreover, since the potential of the discharging connection potential preliminary adjusted signal DCOM supplied to the collector of the discharge-use transistor Tr2 of the driving signal generating circuit 72 is adjusted to be slightly lower than that of the driving signal COM, the power consumption resulting from the potential difference between the two is small. Thus, since the present embodiment allows the power consumption to be lowered and the amount of generated heat to be reduced in comparison to the conventional inkjet printer, measures for dealing with generated heat are not required. Further, the preliminary adjustment, through power amplification by the charging source potential digital power amplifier 28 made up of the charging source potential transistor pair 32, of the charging source potential preliminary adjusted signal CCOM supplied to the collector of the charge-use transistor Tr1 of the driving signal generating circuit 72 makes it possible to accurately adjust the potential of the charging source potential preliminary adjusted signal CCOM. In addition, the preliminary adjustment, through power amplification by the discharging connection potential digital power amplifier 29 made up of the discharging connection potential transistor pair 33, of the discharging connection potential preliminary adjusted signal DCOM supplied to the collector of the discharge-use transistor Tr2 of the driving signal generating circuit 72 makes it possible to accurately adjust the potential of the discharging connection potential preliminary adjusted signal DCOM.

Thus, according to the present embodiment, in order to generate the driving wave-form signal WCOM as a basis of a signal for controlling a driving state of the actuator 22 using the driving wave-form signal generating circuit 70 and output a driving signal COM by amplifying the generated driving wave-form signal WCOM using the charge-use transistor Tr1 and the discharge-use transistor Tr2 connected in a push-pull configuration in the driving signal generating circuit 72, the inkjet printer generates the charging source potential preliminary adjustment wave-form signal WCCOM for making a preliminary adjustment to the charging source potential for the driving signal generating circuit 72, performs pulse modulation of the charging source potential preliminary adjustment wave-form signal WCCOM using the charging source potential modulating circuit 24, electrically amplifies the pulse-modulated charging source potential modulated signal CPWM using the charging source potential transistor pair 32 connected in a push-pull configuration in the charging source potential digital amplifier 28, smoothes the electrically amplified charging source potential preliminary adjusted signal CCOM using the charging source potential ripple filter 30, and outputs the result to the collector of the charge-use transistor Tr1 of the driving signal generating circuit 72. Further, the inkjet printer generates the discharging connection potential preliminary adjustment wave-form signal WDCOM for making a preliminary adjustment to the potential of the discharging connection for the driving signal generating circuit 72, performs pulse modulation of the discharging connection potential preliminary adjustment wave-form signal WDCOM using the discharging connection potential modulating circuit 25, electrically amplifies the pulse-modulated discharging connection potential modulated signal DPWM using the discharging connection potential transistor pair 32 connected in a push-pull configuration in the discharging connection potential digital amplifier 29, smoothes the electrically amplified discharging connection potential preliminary adjusted signal DCOM using the discharging connection potential ripple filter 31, and outputs the result to the collector of the discharge-use transistor Tr2 of the driving signal generating circuit 72. As a result, it is possible to reduce the potential difference between the charging source potential preliminary adjusted signal CCOM and the driving signal COM for charging the charge-discharge actuator 22 and to reduce the potential difference between the discharging connection potential preliminary adjusted signal DCOM and the driving signal COM for discharging the charge-discharge actuator 22, and thereby reduce power consumption.

Further, if the charging source potential preliminary adjusted wave-form signal WCCOM for adjusting the potential of the charging source potential preliminary adjusted signal CCOM is generated by adjusting the voltage values of the charging source potential preliminary adjusted signal CCOM, and the discharging connection potential preliminary adjusted wave-form signal WDCOM for adjusting the potential of the discharging connection potential preliminary adjusted signal DCOM is generated by adjusting the voltage values of the discharging connection potential preliminary adjusted signal DCOM, accuracy of the driving signal COM can be improved and a further reduction in power consumption is possible.

Further, if the charging source potential preliminary adjusted wave-form signal WCCOM for adjusting the potential of the charging source potential preliminary adjusted signal CCOM is generated by adjusting the phase of the charging source potential preliminary adjusted signal CCOM, and the discharging connection potential preliminary adjusted wave-form signal WDCOM for adjusting the potential of the discharging connection potential preliminary adjusted signal DCOM is generated by adjusting the phase of the discharging connection potential preliminary adjusted signal DCOM, accuracy of the driving signal COM can be improved and a further reduction in power consumption is possible.

The following describes a fourth embodiment of the inkjet printer of the present invention with reference to FIG. 15. In the present embodiment, the conceptual construction and control device of the inkjet printer, the methods for generating the driving wave-form signals and the driving signals, and the construction of the actuator selection circuits are the same as those in the first embodiment. In the present embodiment, however, a charging source and discharging connection potential preliminary adjustment circuit 23 is provided in place of the charging source potential preliminary adjustment circuit 26 of the first embodiment. The charging source and discharging connection potential preliminary adjustment circuit 23 is connected to the collector of the charge-use transistor Tr1 of the driving signal generating circuit 72 via a first diode D1 and makes a preliminary adjustment to the potential of source for charging the charge-use transistor Tr1. Further, the charging source and discharging connection potential preliminary adjustment circuit 23 is connected to the collector of the discharge-use transistor Tr2 via a second diode D2, and makes a preliminary adjustment to the potential of the connection for discharging the discharge-use transistor Tr2.

The charging source and discharging connection potential preliminary adjustment circuit 23 includes a charging source and discharging connection potential modulating circuit 35 for pulse modulation of the charging source and discharging connection potential preliminary adjusted wave-form signal WCDCOM generated by the potential preliminary adjusted wave-form signal generating circuit 71 in the same way as the above-described driving wave-form signal WCOM, a charging source and discharging connection potential digital power amplifier 36, which is a so-called class-D amplifier, for electrically amplifying a charging source and discharging connection potential modulated signal CDPWM resulting from pulse modulation by the charging source and discharging connection potential modulating circuit 35, and a charging source and discharging connection potential ripple filter 38 which smoothes the charging source and discharging connection potential preliminary adjusted signal CDCOM resulting from the power amplification by the charging source and discharging potential digital power amplifier 36 and outputs to the collector of the charge-use transistor Tr1 and to the collector of the discharge-use transistor Tr2 of the driving signal generating circuit 72.

The charging source and discharging connection potential modulating circuit 35 for pulse modulation of the charging source and discharging connection potential preliminary adjusted wave-form signal WCDCOM makes use of a regular pulse width modulation (PWM) circuit in the same way as the charging source potential modulating circuit 24 of the first embodiment. The charging source and discharging connection potential digital power amplifier 36, which is a so-called class-D amplifier, includes a charging source and discharging connection potential transistor pair 37 made up of two MOSFET transistors TrP and TrN for substantially amplifying electrical power in the same way as the charging source potential digital power amplifier 29 of the first embodiment, and a gate driver circuit 34 for adjusting the gate-source signals GP and GN of the MOSFETs TrP and TrN based on the charging source and discharging connection potential modulated signal CDPWM from the charging sources and discharging connection potential modulating circuit 35. The charging source and discharging connection potential ripple filter 38 is constructed using a primary LC low-pass filter which, like the charging source potential ripple filter 30 of the first embodiment, may include a combination of a single coil L and a single capacitor C, for instance.

In the present embodiment, by setting the charging source and discharging connection potential preliminary adjusted wave-form signal WCDCOM appropriately, the potential of the charging source and discharging connection potential preliminary adjusted signal CDCOM supplied to the collector of the charge-use transistor Tr1 of the driving signal generating circuit 72 when charging the actuator is adjusted to be slightly higher than that of the driving signal COM, and the potential of the charging source and discharging connection potential preliminary adjusted signal CDCOM supplied to the collector of the discharge-use transistor Tr2 of the driving signal generating circuit 72 when discharging the actuator is adjusted to be slightly lower than that of the driving signal COM. Two methods exist for adjusting the potential of the charging source and discharging connection potential adjusted signal CDCOM. In the plot shown in FIG. 14A, for instance, the actual voltage values of the charging source and discharging connection potential adjusted signal CDCOM have been adjusted to be slightly higher or slightly lower than that of the driving signal COM. In the plot shown in FIG. 14B, the phase of the charging source and discharging connection potential adjusted signal CDCOM has been adjusted to be slightly higher or slightly lower than that of the potential of the driving signal COM by making the potential of the charging source and discharging connection potential adjusted signal CDCOM earlier than that of the driving signal COM.

In the present embodiment, the hatched sections in FIGS. 14A and 14B correspond to power consumptions. In the present embodiment, since the potential of the charging source and discharging connection potential preliminary adjusted signal CDCOM supplied to the collector of the charge-use transistor Tr1 of the driving signal generating circuit 72 is adjusted to be slightly higher than the potential of the driving signal COM, the power consumption resulting from the potential difference between the two is small. Moreover, since the potential of the charging source and discharging connection potential preliminary adjusted signal CDCOM supplied to the collector of the discharge-use transistor Tr2 of the driving signal generating circuit 72 is adjusted to be slightly lower than that of the driving signal COM, the power consumption resulting from the potential difference between the two is small. Thus, since the present embodiment allows the power consumption to be lowered and the amount of generated heat to be reduced in comparison to the conventional inkjet printer, measures for dealing with generated heat are not required. Moreover, the preliminary adjustment, through power amplification by the charging source and discharging source potential digital power amplifier 36 made up of the charging source and discharging connection potential transistor pair 37, of the charging source and discharging potential adjusted signal CDCOM supplied to the collector of the charge-use transistor Tr1 and the discharge-use transistor Tr2 of the driving signal generating circuit 72 makes it possible to accurately adjust the potential of the charging source and discharging connection potential adjusted signal CDCOM.

Thus, according to the present embodiment, in order to generate the driving wave-form signal WCOM as a basis of a signal for controlling a driving state of the actuator 22 using the driving wave-form signal generating circuit 70 and output a driving signal COM by amplifying the generated driving wave-form signal WCOM using the charge-use transistor Tr1 and the discharge-use transistor Tr2 connected in a push-pull configuration in the driving signal generating circuit 72, the inkjet printer generates the charging source and discharging connection potential preliminary adjustment wave-form signal WCDCOM for making a preliminary adjustments to the potential of a charging source and to the potential of a discharging connection for the driving signal generating circuit 72, performs pulse modulation of the charging source and discharging connection potential preliminary adjustment wave-form signal WDCOM using the charging sources and discharging connection potential modulating circuit 35, electrically amplifies the pulse-modulated charging source and discharging connection potential modulated signal CDPWM using the charging source and discharging connection potential transistor pair 37 connected in a push-pull configuration in the charging source and discharging connection potential digital amplifier 36, smoothes the electrically amplified charging source and discharging connection potential preliminary adjusted signal CDCOM using the charging source and discharging connection potential ripple filter 38, and outputs the results to the collector of the charge-use transistor Tr1 and to the collector of the discharge-use transistor Tr2 of the driving signal generating circuit 72. As a result, it is possible to reduce the potential difference between the charging source and discharging connection potential preliminary adjusted signal CDCOM and the driving signal COM for charging and discharging the charge-discharge actuator 22, and thereby reduce power consumption.

Further, if the charging source and discharging connection potential preliminary adjusted wave-form signal WCDCOM for adjusting the potential of the charging source and discharging connection potential preliminary adjusted signal CDCOM is generated by adjusting the voltage values of the charging source and discharging connection potential preliminary adjusted signal CDCOM, accuracy of the driving signal COM can be improved and a further reduction in power consumption is possible.

Further, if the charging source and discharging connection potential preliminary adjusted wave-form signal WCDCOM for adjusting the potential of the charging source and discharging connection potential preliminary adjusted signal CDCOM is generated by adjusting the phase of the charging source and discharging connection potential preliminary adjusted signal CDCOM, accuracy of the driving signal COM can be improved and a further reduction in power consumption is possible.

It is to be understood that although the above embodiments described an example in which the liquid jetting device of the present invention was applied to a so-called line-head inkjet printer, the liquid jetting device of the present invention is applicable to various types of inkjet printers including multipass printers.

Moreover, although the embodiments described the particular example of liquid jetting device of the present invention in an inkjet-type printing device, the present invention is not limited to such an arrangement, and may be a liquid jetting device ejecting or jetting liquids other than ink (including liquid media in which particles of functional materials are distributed and fluid media such as gels) and fluid bodies other than liquids (such as solid capable of flowing as fluid media and being jetted). For instance, the present invention may be a liquid media jetting device for jetting a liquid medium including in the form of dispersion and solution a material such as an electrode material or colorant used for producing liquid crystal displays, EL (electro-luminescent) displays, surface emitting displays, color filters, in a liquid jetting device for jetting organic materials used for producing biochips, or in an liquid jetting device for jetting liquids for use as test materials in a precision pipettes. Further, the present invention may be a liquid jetting device for jetting a lubricant with pinpoint accuracy in an intricate machine such as a watch and a camera, a liquid jetting device for jetting onto a substrate a transparent resin liquid such ultraviolet-hardening resin for forming semispherical micro-lenses (optical lenses) used in optical communications devices and the like, a liquid jetting device for jetting an acid or alkaline etching liquid for etching a substrate or the like, a flow jetting device for jetting gel, or a fluid jetting-type recording device for jetting a solid exemplified by a toner or the like. Thus, the present invention can be applied to any one of this type of jetting device.

What is claimed is:

1. A liquid jetting device including a plurality of nozzles provided in a liquid jetting head, a charge-discharge actuator provided in correspondence with each nozzle, and a driving section for applying a driving signal to the charge-discharge actuator to jet liquid from the corresponding nozzle, the liquid jetting device comprising:

a driving wave-form signal generating section configured to generate a driving wave-form signal as a basis of a signal for controlling a drive state of the actuator;

a driving signal generating section configured to amplify the driving wave-form signal generated by the driving wave-form signal generating section using a charge-use transistor and a discharge-use transistor connected in a push-pull configuration, and output a driving signal;

a charging source potential preliminary adjusted wave-form signal generating section configured to generate a charging source potential preliminary adjusted wave-form signal for making a preliminary adjustment to a potential of a charging source for the driving signal generating section; and a charging source potential preliminary adjustment section provided both between the charging source of the driving signal generating section and the driving signal generating section, and configured to make a preliminary adjustment to the charging source potential to the driving signal generating section based on the charging source potential preliminary adjusted wave-form signal generated by the charging source potential preliminary adjusted wave-form signal generating section, wherein the charging source potential preliminary adjustment section includes: a charging source potential modulating subsection configured to perform pulse modulation on the charging source potential preliminary adjusted wave-form signal generated by the charging source potential preliminary adjusted wave-form signal generating section;

a charging source potential digital power amplifier configured to electrically amplify, using a charging source potential transistor pair connected in a push-pull configuration, a charging source potential modulated signal resulting from pulse modulation by the charging source potential modulating subsection; and a charging source potential ripple filter configured to output the charging source potential preliminary adjusted signal resulting from power amplification by the charging source potential digital power amplifier to a collector of the charge-use transistor of the driving signal generating section.

2. The liquid jetting device according to claim 1, wherein the charging source potential preliminary adjusted wave-form signal generating section generates the charging source potential preliminary adjusted wave-form signal for adjusting the potential of the charging source potential preliminary adjusted signal by adjusting a phase of the charging source potential preliminary adjusted signal.

3. The liquid jetting device according to claim 1, wherein the charging source potential preliminary adjusted wave-form signal generating section generates the charging source potential preliminary adjusted wave-form signal for adjusting the potential of the charging source potential preliminary adjusted signal by adjusting a voltage value of the charging source potential preliminary adjusted signal.

* * * * *